US005894989A

United States Patent [19]

Yasuda et al.

[11] Patent Number: 5,894,989

[45] Date of Patent: Apr. 20, 1999

[54] ELECTROSTATIC POWDER COATING GUN

[75] Inventors: Shinichiro Yasuda, Tokyo; Masayuki Maruta; Yukiya Sato, both of Wakayama, all of Japan

[73] Assignee: Kao Corporation, Tokyo, Japan

[21] Appl. No.: 08/844,776

[22] Filed: Apr. 22, 1997

[30] Foreign Application Priority Data

Apr. 25, 1996 [JP] Japan ..... 8-130900
Apr. 25, 1996 [JP] Japan ..... 8-130912

[51] Int. Cl.[6] ..... B05B 5/16

[52] U.S. Cl. ..... 239/3; 239/704

[58] Field of Search ..... 239/3, 690, 691, 239/692, 704–709

[56] References Cited

U.S. PATENT DOCUMENTS

| | | | |
|---|---|---|---|
| 913,941 | 3/1909 | Blake | 239/704 X |
| 2,657,339 | 10/1953 | Hampo | 239/704 X |
| 4,219,864 | 8/1980 | Grünenfelder et al. | 239/704 X |
| 4,359,192 | 11/1982 | Takahashi et al. | 239/692 |
| 4,886,815 | 12/1989 | Ruud | 239/704 X |

FOREIGN PATENT DOCUMENTS

| | | | |
|---|---|---|---|
| 55166 | 10/1951 | France . | |
| A07000874 | 1/1995 | Japan . | |
| A07024366 | 1/1995 | Japan . | |
| 912296 | 3/1982 | U.S.S.R. . | |
| 1351944 | 5/1974 | United Kingdom . | |
| 1351949 | 5/1974 | United Kingdom | 239/704 |

*Primary Examiner*—Kevin Weldon
*Attorney, Agent, or Firm*—Birch, Stewart, Kolasch & Birch, LLP

[57] ABSTRACT

A plurality of linear elements or meshed elements are arranged in a powder paint transportation path in an electrostatic powder coating gun. The materials of the linear elements and meshed elements are capable of charging the powder paint by static electricity generated by friction between the powder paint and the elements.

16 Claims, 24 Drawing Sheets

ELECTROSTATIC POWDER COATING GUN

FIELD OF THE INVENTION

The present invention relates to an electrostatic powder coating gun for charging powder paint used for electrostatic powder coating.

DESCRIPTION OF RELATED ART

In recent years, many efforts have been made on an international level to prevent the deterioration of the global environment, because changes of the global environmental generate problems. In the field of coating technology, paint containing organic solvent generates various problems, for example, public pollution due to organic solvent spilled by coating work, environmental pollution due to volatile organic compound (VOC), and malodor. To resolve these problems, high-solid paint, aqueous paint, and methods of powder coating have been developed. The powder coating, in particular, is free from the problems of public pollution and hazards due to organic solvents, because it uses powder paint containing no organic solvent, so that it is useful to resolve the above problems. Other advantages of the powder coating are ease of thick coating and automated operation.

The electrostatic powder coating is one of the methods of powder coating. It uses powder paint positively or negatively charged to form coating film on the earthed subject of coating by blowing the powder paint. For the electrostatic powder coating, a powder coating gun, such as a corona gun or triboelectric gun is used to charge and blow the powder paint.

The corona gun applies high voltage, for example, 70 to 100 KV, to corona electrodes arranged at the exit of the powder paint by using a high-voltage generator, to achieve corona discharge from the electrodes. By this discharge, the powder paint, which is transporting by pressurized air is charged. The charged powder paint thus travels in the electric field formed between the corona gun and the subject of coating, and then adheres to the subject of coating to form the coating film.

When the corona gun is used, however, only a few percents of the ions discharged from the corona electrodes are available for charging the powder paint. The remaining unutilized ions form ozone and generate an odor. Also, because electrostatic repulsion, known as back ionization, occurs at high speeds, craters and pinholes are likely to appear in the coating film. In addition, a phenomenon known as the Faraday cage effect occurs, in which the entry of powder paint into hollows of the subject of coating is interfered with. This decreases adhesion efficiency of the powder paint, so that it difficult to obtain a smooth uniform coating film. As another problem, dust adhesion to the coating film is likely.

Conventional triboelectric guns transport the powder paint via a practically straight transportation path by pressurized air. The powder paint is charged by static electricity generated by friction between the powder paint and the transportation face surrounding the transportation path. No ionic flow is therefore produced. For this reason, ozone odor is not generated and the entry of the powder paint into the hollows of the subject of coating is good. Also, because electrostatic repulsion occurs more slowly than in the case of corona guns, craters and pinholes are unlikely to occur on the coating film. This facilitates the obtainment of a smooth uniform coating film with minimum dust adhesion.

It should be noted, however, that the powder paint transportation path of the conventional triboelectric guns is practically straight. For this reason, the chance of contact between the transportation face and particles of the powder paint is so little that the charge efficiency is low. As a result, the maximum blowing capacity is limited, the adhesion efficiency is low, and, when the subject of coating has a wide surface area, coating takes long time.

Another conventional triboelectric gun, which has a large number of bent thin tubes, uses the inside of the tubes as a powder paint transportation path (Japanese Patent Laid-Open HEI No. 7-874). This arrangement provides an increased inner face area around the transportation path to increase the chance of contact between the inner face of the transportation path and particles of the powder paint, so that the charge efficiency is improved.

When such a large number of bent thin tubes serve as a transportation path of the powder paint, however, structural complexity increases cost and hampers maintenance. Structural complexity also hampers cleaning, so that the use of powder paint of different colors is difficult.

In another conventional triboelectric gun, a rotary blade is provided in the transportation path of the powder paint (Japanese Patent Laid-Open HEI No. 7-24366). This arrangement rotates the powder paint to increase the chance of contact between the inner surface of the transportation path and the particles of the powder paint to improve the charge efficiency.

Due to rapid wear of the inner surface of the transportation path, however, the gun's life is short. Also, charge efficiency reduction can occur due to accumulation of the powder paint on the transportation face, so that stably charging to the powder paint is interfered with. In addition, the coating film has recently been required to be as thin as about 25 to 40 μm, while the coating film thickness required is about 100 to 300 μm in conventional powder coating. It is therefore necessary to reduce the mean diameter of the particles constituting the powder paint from about 30–40 μm (conventional) to about 10–20 μm. As the particle diameter decreases, the specific surface increases dramatically. In this case, it is difficult to give a sufficient chance of contact between the transportation face and the particles, in the conventional triboelectric guns, resulting in significantly reduced charge efficiency. As a result, the maximum blowing capacity decreases further, coating efficiency decreases further, and coating is difficult when the subject of coating has a great surface area.

The present invention is directed to provide an electrostatic powder coating gun capable of resolving the above-described problems.

SUMMARY OF THE INVENTION

The electrostatic powder coating gun of the present invention comprises a transportation path for powder paint, and a plurality of linear elements or a meshed element arranged in the transportation path so that the linear elements or meshed element can come in contact with the powder paint on transportation, wherein the material of the linear elements and meshed element is that which enables the powder paint to be charged by static electricity generated by friction between the powder paint and the linear elements or meshed element.

One of the features of the electrostatic powder coating gun of the present invention is that it comprises a transportation path for powder paint, and a plurality of linear elements arranged in the transportation path so that the linear elements can come in contact with the powder paint on transportation, wherein the linear elements are cantilevered so as to be flexible, and wherein the material of the linear elements is that which enables the powder paint to be charged by static electricity generated by friction between the powder paint and the linear elements.

Another feature of the electrostatic powder coating gun of the present invention is that it comprises a transportation path for powder paint, and a meshed element arranged in the transportation path so that the meshed element can come in contact with the powder paint on transportation, wherein the mesh size of the meshed element is greater than the size of the particles constituting the powder paint, and wherein the material of the meshed element is that which enables the powder paint to be charged by static electricity generated by friction between the powder paint and the meshed element.

Still another feature of the electrostatic powder coating gun of the present invention is that it comprises a transportation path for powder paint, and a plurality of linear elements arranged in the transportation path so that the linear elements can come in contact with the powder paint on transportation, wherein the linear elements are supported at both ends, and wherein the materials of the linear elements is that which enables the powder paint to be charged by static electricity generated by friction between the powder paint and the linear elements.

According to the present invention, ozone odor is not generated, the entry of powder paint into the hollows of the subject of coating is good, and craters and pinholes are unlikely to occur in the coating film, because the powder paint is charged by static electricity generated by friction. This facilitates the obtainment of a smooth uniform coating film with minimum dust adhesion.

The static electricity can be generated by contacting the linear elements, meshed element or linear element supported at both ends in the transportation path with the particles of the powder paint. The chance of contact between the linear elements or meshed element and the particles increases in proportion to the number of linear elements or the number of opens of the meshed element. By this arrangement, the charge efficiency of the particle of the powder paint can be improved significantly. The maximum blowing capacity and coating efficiency of the powder paint is increased by improving the charge efficiency, so that quick coating is possible even when the subject of coating has a wide surface area.

Because the linear element is flexible by contact with the powder paint, the wear due to the contact is mitigated, resulting in extended life. Also, because the flexibility of the linear elements prevents the powder paint from accumulating thereon, the powder paint can be stably charged.

Also, because structural simplicity reduces cost and facilitates maintenance and cleaning, the use of powder paint of different colors is facilitated.

It is preferable that the transportation path have a portion surrounded by a cylindrical face, and that the linear elements cantilevered by the cylindrical face extend toward the transportation path. It is also preferable that the transportation path have a portion surrounded by a cylindrical face, that a support element passing the central axis of the cylindrical face is provided, and that the linear elements cantilevered by the support element extend toward the transportation path.

By this arrangement, the chance of contact between the linear elements and the powder paint can be uniformized to uniformly improve charge efficiency, enabling the obtainment of a uniform coating film.

It is preferable that the linear elements are arranged along a spiral around the transporting direction of the powder paint.

By this arrangement, the powder paint can be rotated, so that the chance of contact between the linear elements and the powder paint is increased, resulting in the improvement of the charge efficiency.

It is preferable that the transportation path comprises a plurality of portions surrounded by a plurality of mutually concentric cylindrical faces, and that the linear elements cantilevered by each cylindrical face extend toward each portion of the transportation path.

By this arrangement, the chance of contact between the linear elements and the powder paint can be increased to improve the charge efficiency. It is also possible to uniformly charge the powder paint by uniformly dispersing the powder paint, enabling the obtainment of a uniform coating film.

It is preferable that means for charging each linear element or meshed element is provided.

By this arrangement, the charge efficiency of the powder paint can be further improved.

It is preferable that the transportation path has a transporting direction changing portion provided with a blade for changing the transporting direction of the powder paint, and that the portion of the transportation path positioned in the downstream side of the changing portion constitutes the charging portion where the linear elements are arranged.

Alternatively, it is preferable that the transportation path has a transporting direction changing portion provided with a blade for changing the transporting direction of the powder paint, and that the meshed element is arranged at a position where the powder paint passes after the change of the transporting direction.

By dispersing the powder paint with the blade, the chance of contact between the linear elements and the powder paint can be increased to improve the charge efficiency.

It is preferable that the blade is arranged along a spiral around the powder paint transporting direction before the change, and is rotated by the pressure of gas for transporting the powder paint. It is also preferable that a plurality of blade are provided along the transporting direction before the change, and that the surface area of the blade positioned in the downstream side is greater than that positioned in the upstream side. By this arrangement, the powder paint can be uniformly dispersed and charged when the transporting direction is changed.

It is preferable that there is a means for dispersing the powder paint introduced in the transportation path before the powder is brought into contact with the linear elements or meshed element. By this arrangement, the powder paint can be uniformly charged.

It is preferable that the meshed element is formed along a cylindrical face surrounding the blade. By this arrangement, the chance of contact between the meshed element and the powder paint dispersed by the blade can be significantly increased to improve the charge efficiency.

It is preferable that the meshed element formed along the cylindrical face is rotated by the pressure of the gas for transporting the powder paint. By this arrangement, the meshed element can contact with the powder paint without localizing the contact point to prevent the meshed element from clogging.

According to the electrostatic powder coating gun of the present invention, a smooth uniform coating film with minimum dust adhesion can be obtained. It is also possible to increase the maximum powder paint blowing capacity and coating efficiency, so that quick coating is achieved even when the subject of coating has a wide surface area. Also, the life of the linear elements, which come in contact with the powder paint to generate the static electricity, is extended, because wear is unlikely. Also, the powder paint can be stably charged because powder paint accumulation is unlikely. Also, because structural simplicity reduces cost and facilitates maintenance and cleaning, the use of powder paint of different colors is facilitated.

BRIEF DESCRIPTION OF THE DRAWINGS

FIG. 3 (2) is an oblique view of the linear elements and cylindrical element of the first embodiment of the present invention.

DETAILED DESCRIPTION OF PREFERRED EMBODIMENTS

First embodiment

A first embodiment of the present invention is hereinafter described with reference to FIGS. 1 through 4.

Figure 1:
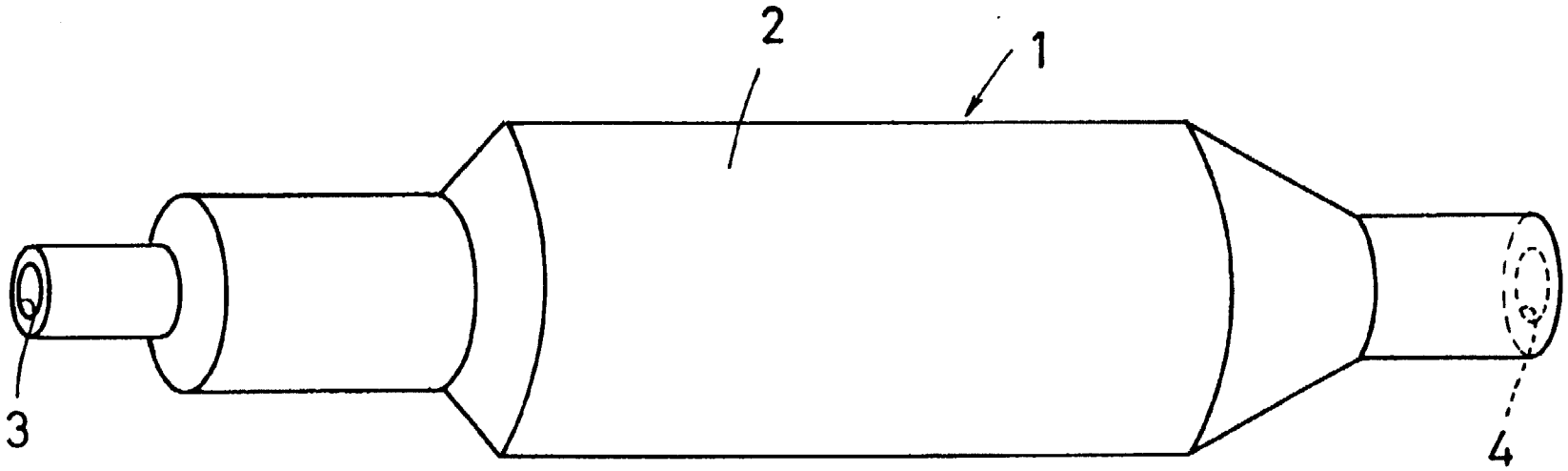
FIG. 1 is an oblique view of the electrostatic powder coating gun of the first embodiment of the present invention.

The electrostatic powder coating gun 1 illustrated in FIG. 1 has a cylindrical body 2 having a paint inlet 3 and a paint outlet 4. Powder paint transported by pressurized air is introduced from the inlet 3 into the body 2. The powder paint charged in the body 2 is blown out together with the pressurized air from the outlet 4. The powder paint is blown to the subject of coating to form a coating film. The body 2 is preferably formed from an insulating material or coated with an insulating material such as rubber.

Figure 2:
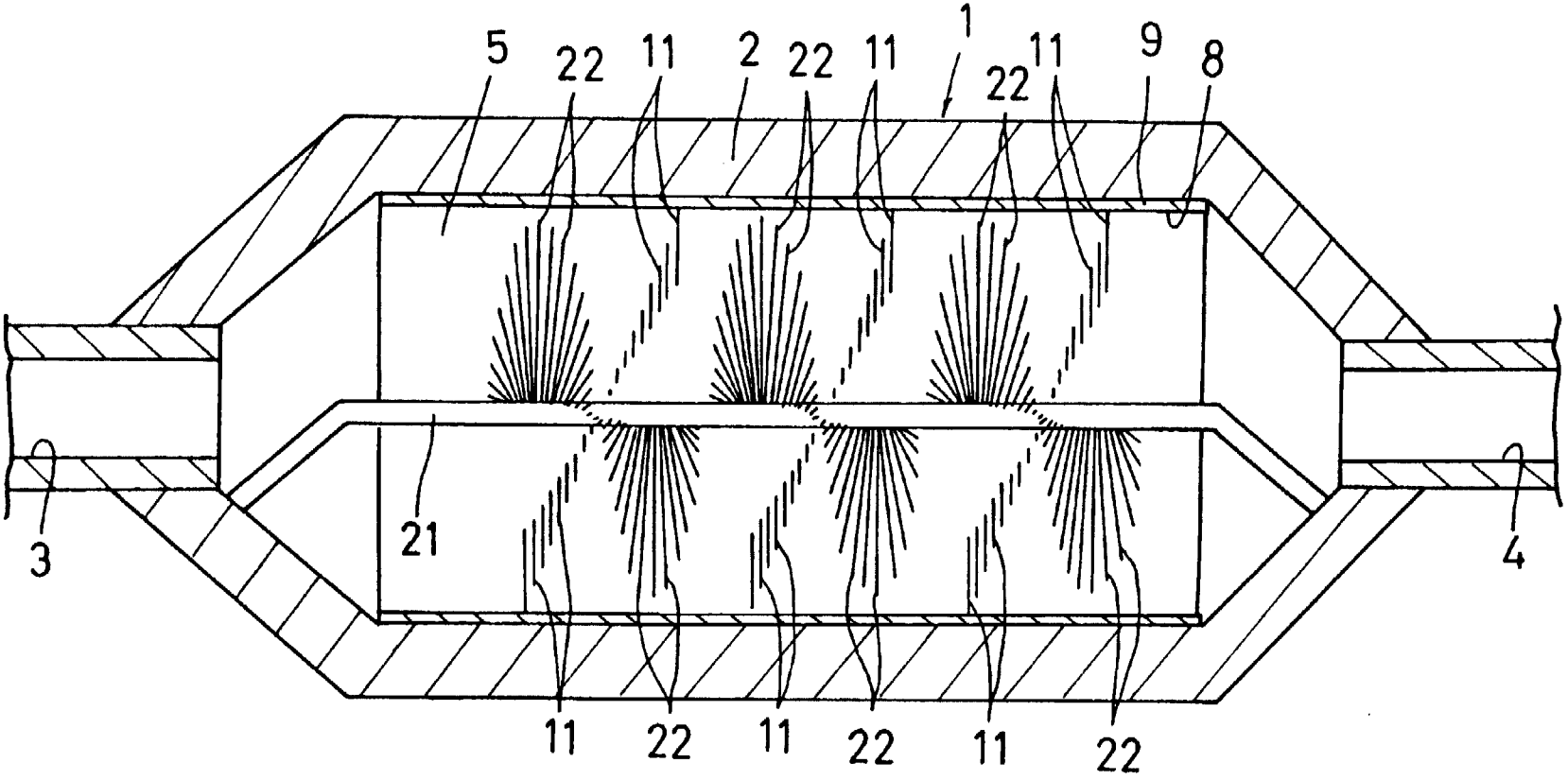
FIG. 2 is a longitudinal cross-sectional view of the electrostatic powder coating gun of the first embodiment of the present invention.

As illustrated in FIG. 2, the inside of the body 2 constitutes a transportation path 5 for the powder paint. The transportation path 5 is surrounded by a cylindrical face 8 between the inlet and the outlet. The cylindrical face 8 is configured with the inner circumference of a cylindrical element 9 bonded to the inner circumference of the body 2.

By the cylindrical face 8, a plurality of first linear elements 11 are cantilevered so that the elements 11 are flexible. The plurality of first linear elements 11 extend toward the transportation path 5 like a brush. Each first linear element 11 arranged in the transportation path 5 is capable of coming in contact with the powder paint on transportation. Each first linear element 11 is extended along the radial direction of the cylindrical face 8. Also, each first linear element 11 is arranged along a spiral around the transporting direction of the powder paint.

Figure 3:
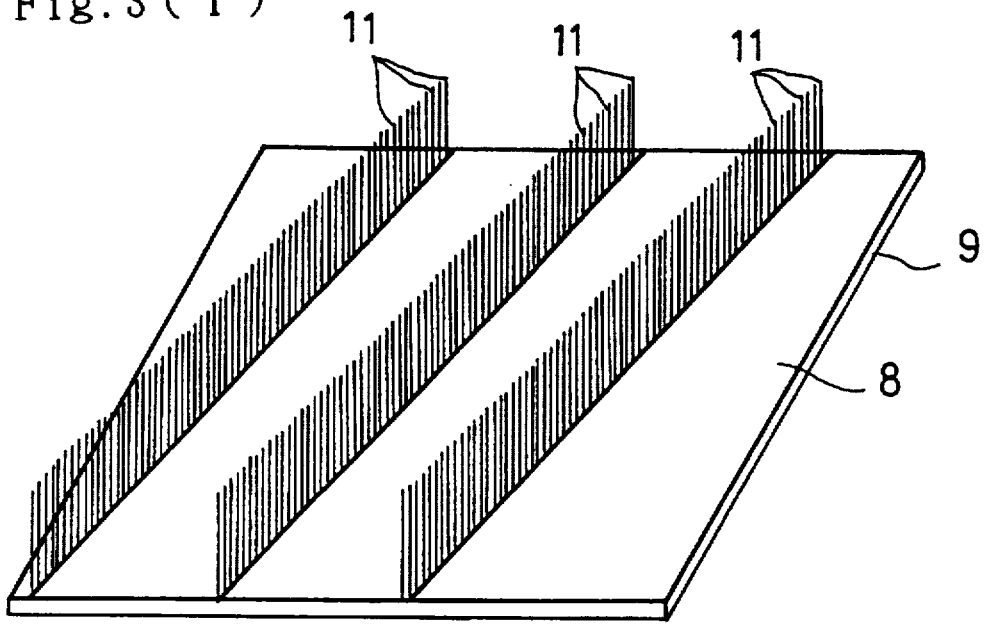
FIG. 3 (1) is a development of the linear elements and cylindrical element of the first embodiment of the present invention.
Figure 3:
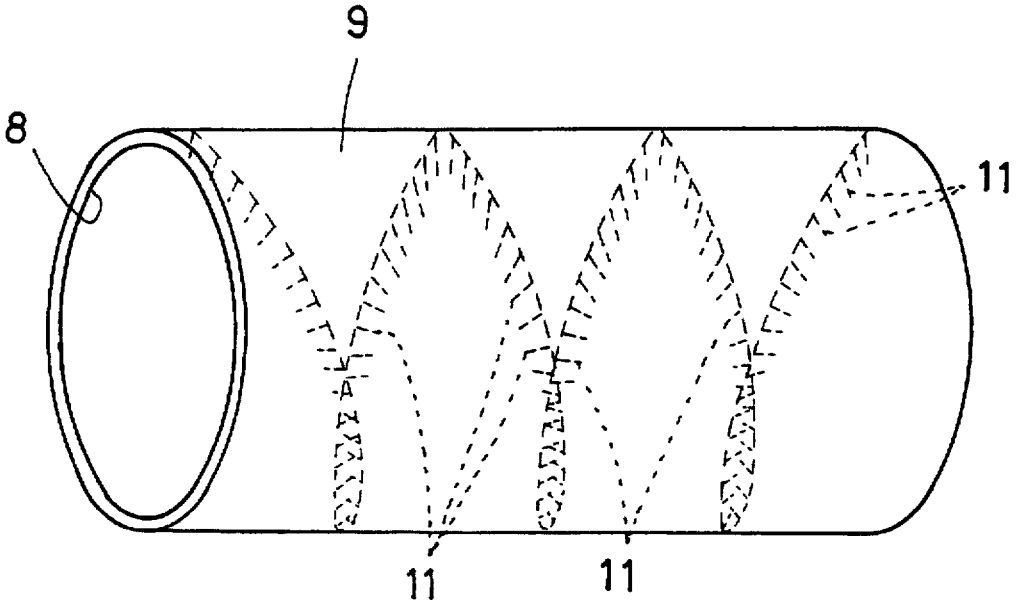

The cylindrical element 9 is made of a flexible square plate-like material illustrated in FIG. 3 (1), which is cylindrically curved as illustrated in FIG. 3 (2). The square plate-like material is, for example, flexible rubber. Each first linear element 11 is attached to the cylindrical element 9 before curving the plate-like material. In the present embodiment, since second linear elements 22 described below are provided, the length of each first linear element 11 is shorter than the radius of the transportation path 5 surrounded by the cylindrical face 8.

A support element 21 passing the central axis of the cylindrical face 8 in the transportation path 5 is attached to the body 2. By the support element 21, a plurality of second linear elements 22 are cantilevered so that the elements 22 are flexible. Each second linear element 22 extends toward the transportation path 5. By this arrangement, each second linear element 22 arranged in the transportation path 5 is capable of coming in contact with the powder paint on transportation. The direction of extension of each second linear element 22 is the radial direction of the cylindrical face 8. Each second linear element 22 is arranged along a spiral around the transporting direction of the powder paint.

Each second linear element 22 and each first linear elements 11 are arranged so that they do not interfere with each other.

Figure 4:
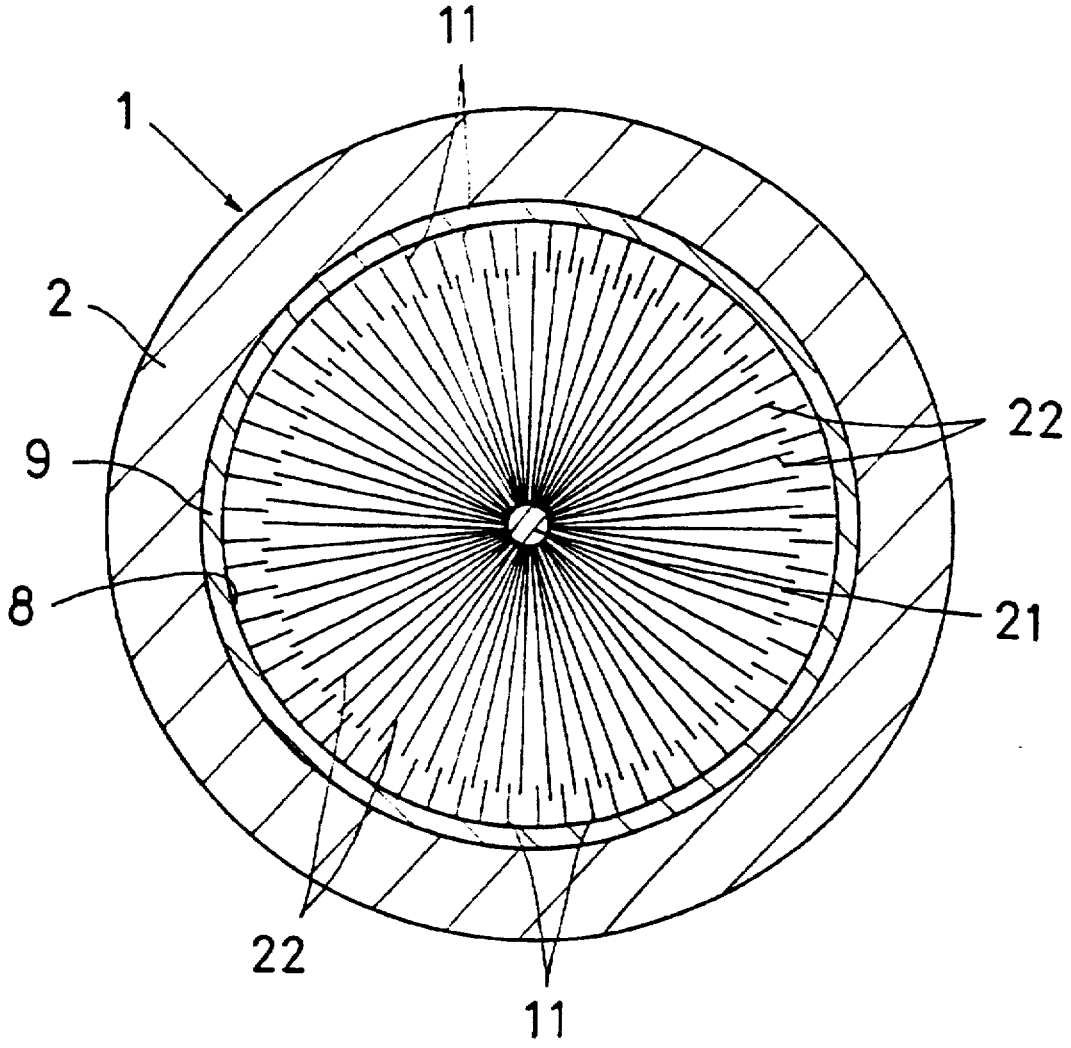
FIG. 4 is a transverse cross-sectional view of the electrostatic powder coating gun of the first embodiment of the present invention.

As illustrated in FIG. 4, the length of each second linear element 22 is shorter than the radius of the cylindrical face 8. The length of each first linear element 11 is longer than the distance between each tip of the second linear element 22 and the cylindrical face 8. By this arrangement, the powder paint passing between the second linear elements 22 and the cylindrical face 8 comes in contact with the first linear elements 11. In place of this arrangement, the tip of each first linear element 11 can be brought into contact with the support element 21, and the tip of each second linear element 22 can be brought into contact with the cylindrical face 8.

The material of each of the linear elements 11 and 22 is electroconductive substance, such as an organic high molecular compound or a metal, which enables the powder paint to be charged by static electricity generated by friction between the powder paint and the elements 11, 22. The radius and number of the linear elements 11 and 22 are set so as to ensure a sufficient powder paint blowing capacity.

Second embodiment

A second embodiment of the present invention is hereinafter described with reference to FIGS. 5 through 7.

Figure 5:
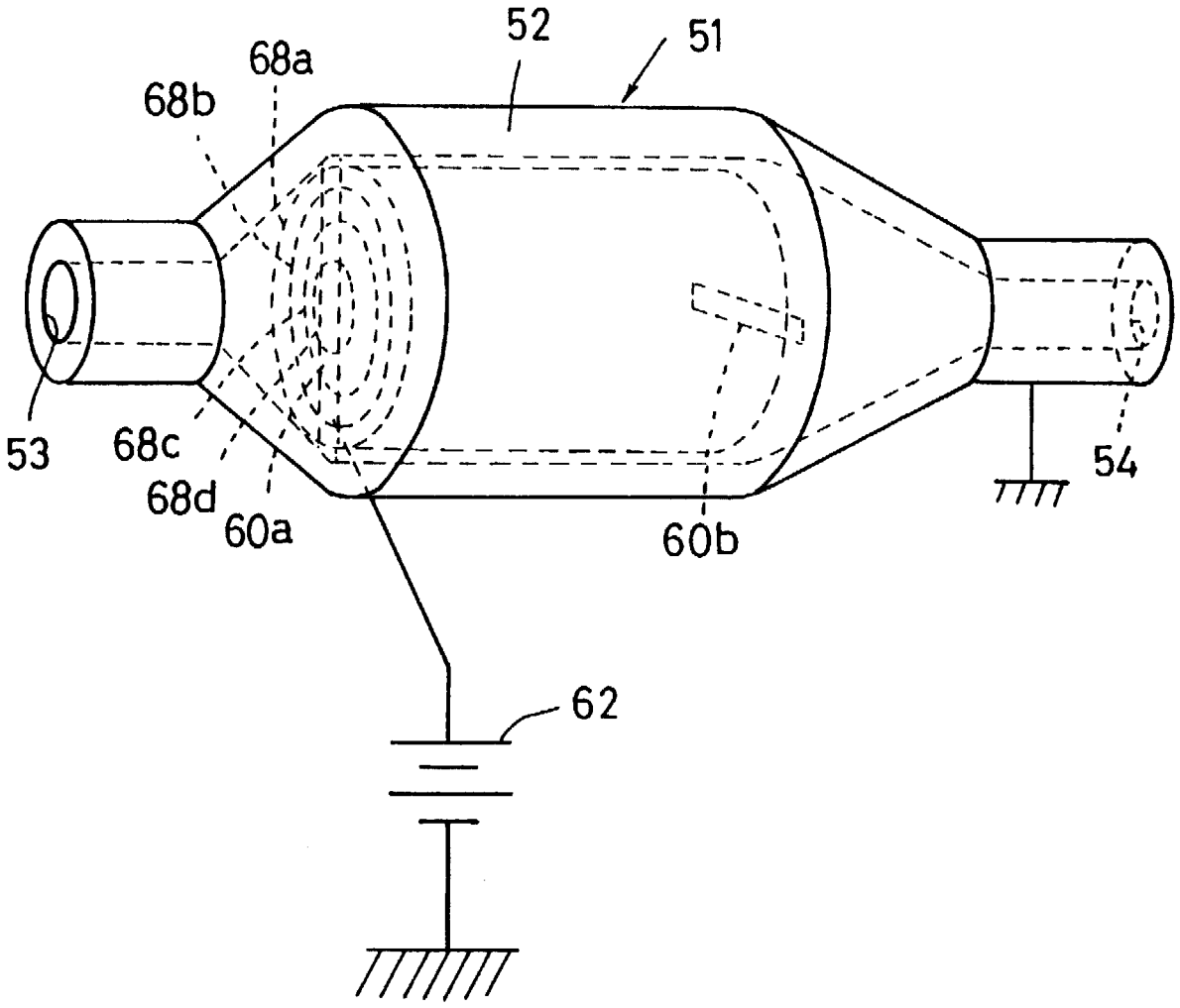
FIG. 5 is an oblique view of the electrostatic powder coating gun of the second embodiment of the present invention.

The electrostatic powder coating gun 51 illustrated in FIG. 5 has a cylindrical body 52. Powder paint transported by pressurized air is introduced from a paint inlet 53 into the body 52. The powder paint is blown out from a paint outlet 54 together with the pressurized air after being charged in the body 52. The powder paint is blown to the subject of coating. The body 52 is preferably formed from an insulating material or coated with an insulating material such as rubber.

Figure 6:
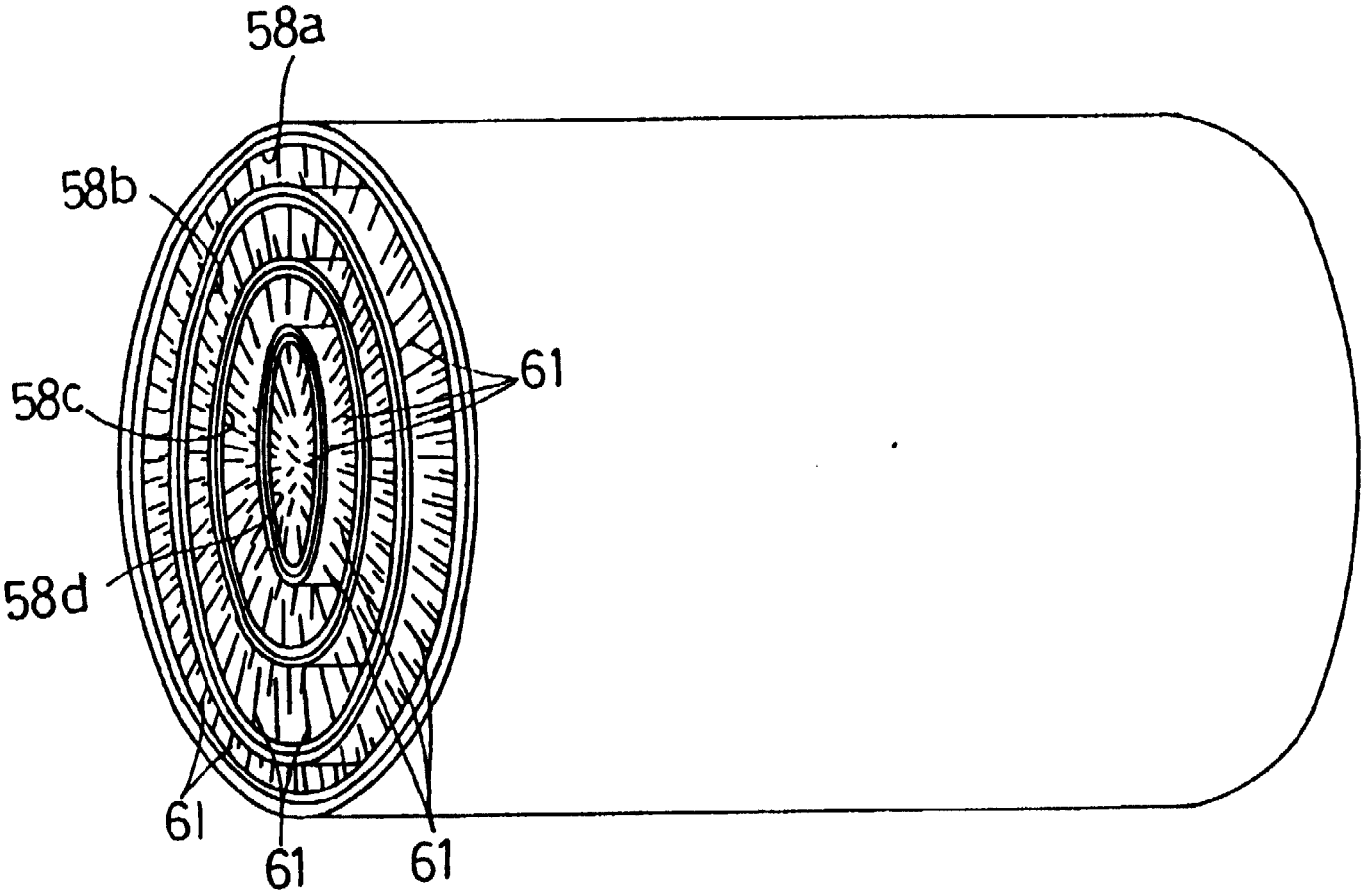
FIG. 6 is an oblique view of the linear elements and cylindrical element of the second embodiment of the present invention.
Figure 7:
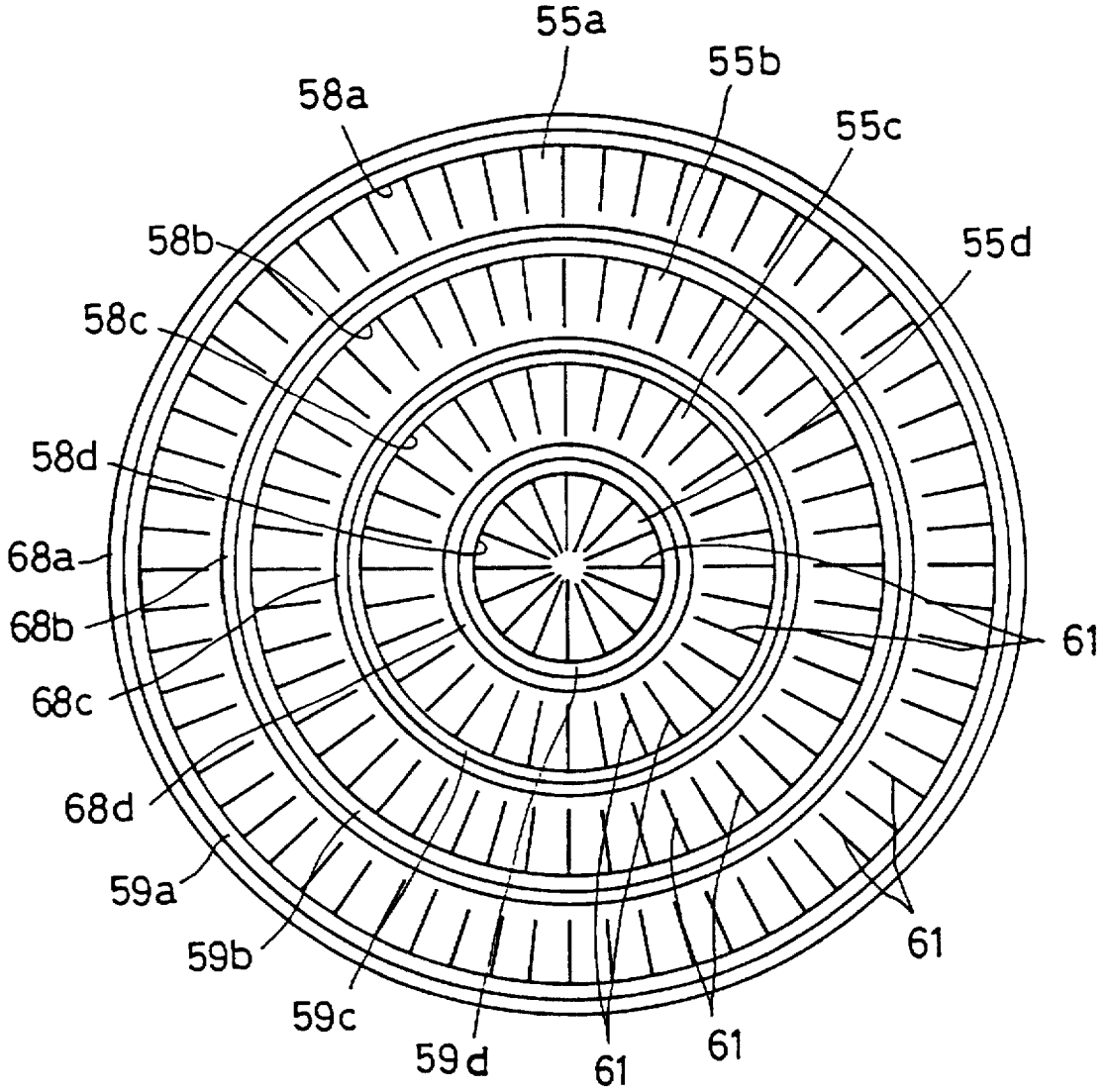
FIG. 7 is a transverse cross-sectional view of the electrostatic powder coating gun of the second embodiment of the present invention.

As illustrated in FIGS. 6 and 7, the inside of the body 52 constitutes a transportation path for the powder paint comprising a plurality of portions 55*a*, 55*b*, 55*c* and 55*d*. The transportation path portions 55*a*, 55*b*, 55*c* and 55*d* are surrounded by a plurality of mutually concentric cylindrical faces 58*a*, 58*b*, 58*c* and 58*d* between the inlet and the outlet.

The cylindrical faces 58*a*, 58*b*, 58*c* and 58*d* are configured with the inner circumferences of cylindrical elements 59*a*, 59*b*, 59*c* and 59*d* bonded to the inner circumferences of cylindrical retention elements 68*a*, 68*b*, 68*c* and 68*d*. The retention elements 68*a*, 68*b*, 68*c* and 68*d* are mutually joined by joint elements 60*a* and 60*b* attached to the front and rear ends thereof, as illustrated in FIG. 5. The joint elements 60*a* and 60*b* are fixed to the body 52.

A plurality of linear elements 61 are cantilevered on each of the cylindrical faces 58*a*, 58*b*, 58*c* and 58*d* so that the elements 61 are flexible. The linear elements 61 extend toward the transportation path portions 55*a*, 55*b*, 55*c* and 55*d* like a brush. By this arrangement, each linear element 61 arranged in the transportation path 5 is capable of coming in contact with the powder paint on transportation. Each linear element 61 extends along the radial direction of each of the cylindrical faces 58*a*, 58*b*, 58*c* and 58*d*, and is distributed over the entire region of each of the cylindrical faces 58*a*, 58*b*, 58*c* and 58*d*. In place of this arrangement, a plurality of linear elements can be cantilevered by the cylindrical face on the outer circumference of the cylindrical element bonded to the outer circumference of each of the retention elements 68*a*, 68*b*, 68*c* and 68*d* so that the linear elements are flexible.

Each of the cylindrical elements 59*a*, 59*b*, 59*c* and 59*d* is made of a flexible square plate-like material, which is cylindrically curved. Each linear element 61 is attached to each of the cylindrical elements 59*a*, 59*b*, 59*c* and 59*d* before curving the plate-like material. The material of each of the cylindrical elements 59*a*, 59*b*, 59*c* and 59*d* is electroconductive substance, such as rubber containing electroconductive particles. The length of each linear element 61 is roughly equal to the radial dimension of each of the transportation path portion 55*a*, 55*b*, 55*c* and 55*d*.

As illustrated in FIG. 5, a power source 62 for charging each linear element 61 is provided. The power source 62 is connected to one joint element 60*a* at one electrode and earthed at the other electrode. The material of the joint element 60*a*, retention elements 68*a*, 68*b*, 68*c* and 68*d* , cylindrical elements 59*a*, 59*b*, 59*c* and 59*d* , and linear elements 61 is electroconductive substance. By this arrangement, frictional charging of the powder paint as described below is promoted by the charge applied to each linear element 61. The insulating portion of the body 52 is preferably earthed.

The material of each of the linear elements 61 is electroconductive substance, such as a metal or an organic high molecular compound containing electroconductive particles, which enables the powder paint to be charged by static electricity generated by friction between the powder paint and the elements 61. The radius and number of the linear elements 61 are set so as to ensure a sufficient powder paint blowing capacity.

Third embodiment

A third embodiment of the present invention is hereinafter described with reference to FIGS. 8 through 10.

Figure 8:
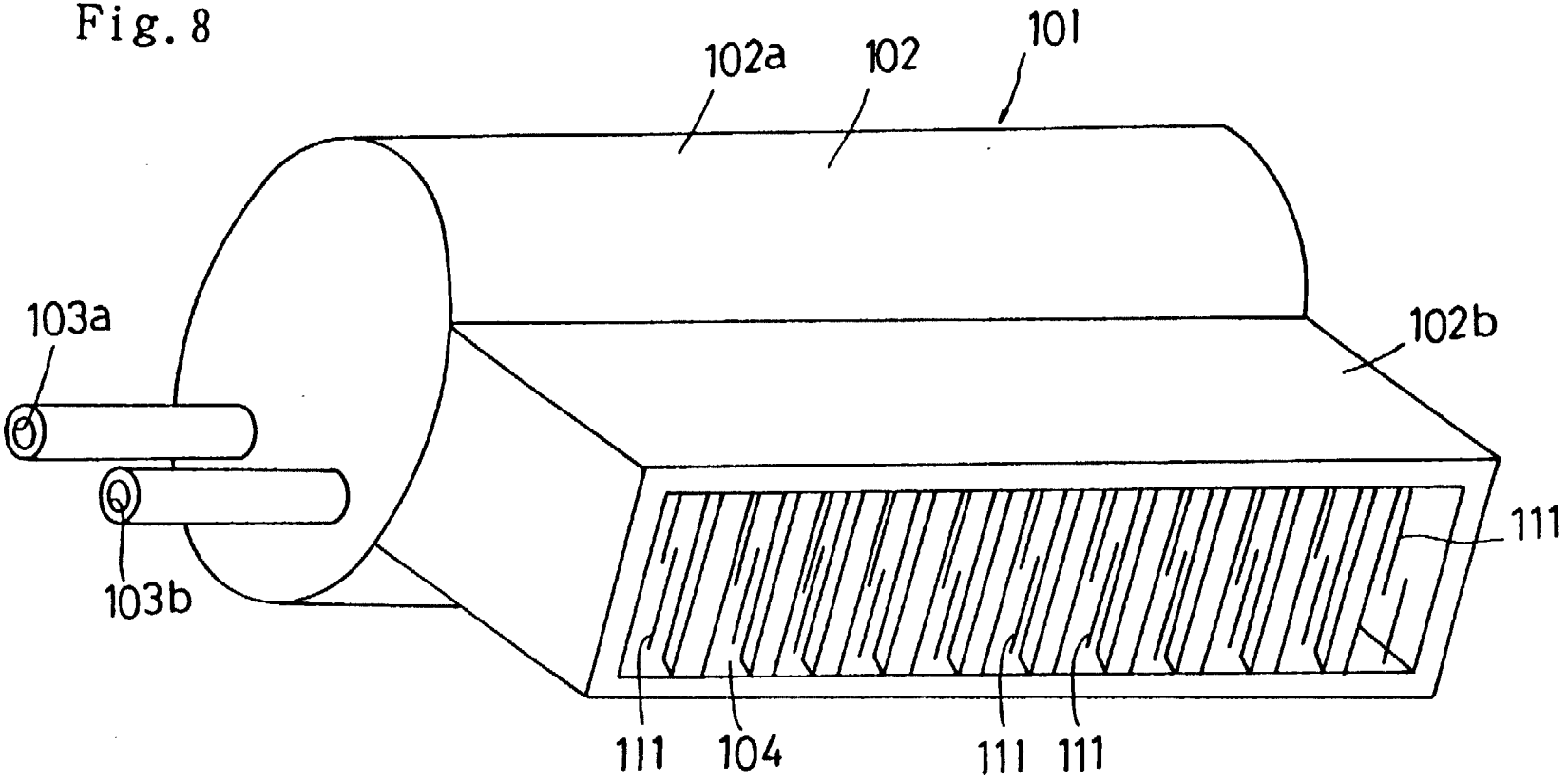
FIG. 8 is an oblique view of the electrostatic powder coating gun of the third embodiment of the present invention.

The body 102 of the electrostatic powder coating gun 101 illustrated in FIG. 8 has a cylindrical portion 102*a* and a rectangular parallelopipedic portion 102*b* extending from the outer circumference of the cylindrical portion 102*a*. On one end face of the cylindrical portion 102*a*, a paint inlet 103*a* and an auxiliary air inlet 103*b* are formed. On the rectangular parallelopipedic portion 102*b*, a paint outlet 104 is formed. Powder paint transported by pressurized air is introduced from the paint inlet 103*a* into the body 102. Pressurized air is introduced into the body 102 from the auxiliary air inlet 103*b*. The powder paint charged in the body 102 is blown out together with the pressurized air from the outlet 104. The powder paint is blown to the subject of coating to form a coating film. The body 102 is preferably formed from an insulating material or coated with an insulating material such as rubber.

Figure 9:
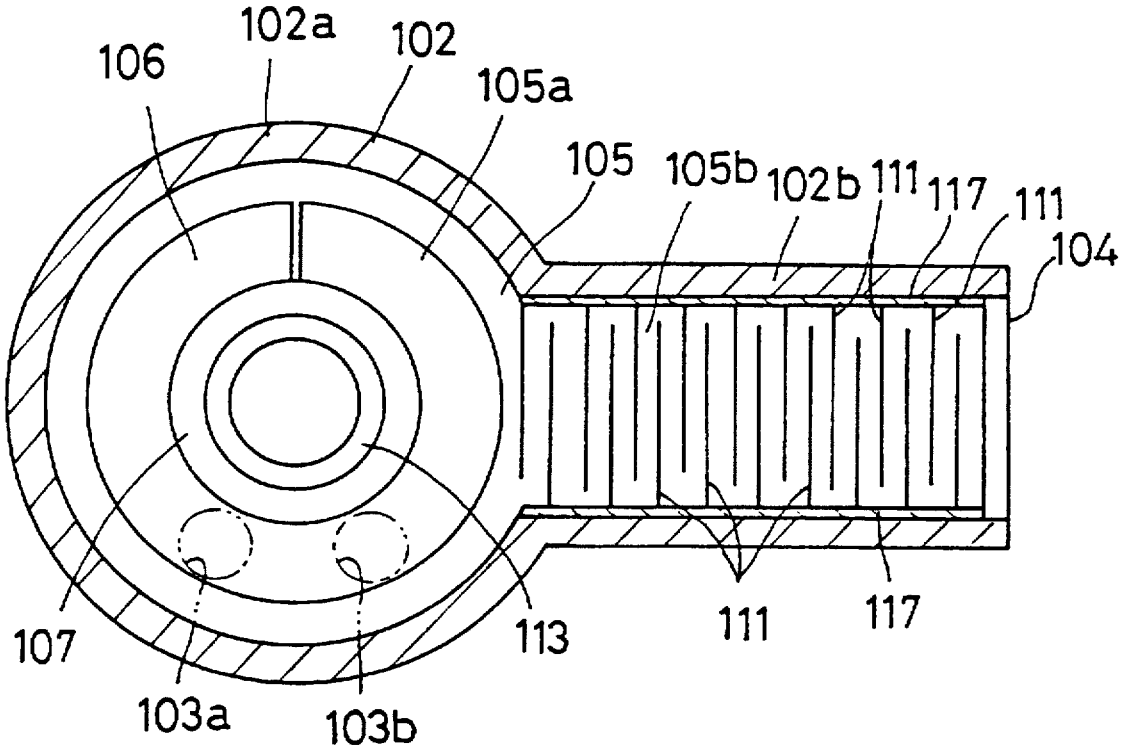
FIG. 9 is a transverse cross-sectional view of the electrostatic powder coating gun of the third embodiment of the present invention.

As illustrated in FIG. 9, the inside of the body 102 constitutes a transportation path 105 for the powder paint. The transportation path 105 has a transporting direction changing portion 105*a* in the cylindrical portion 102*a* and a charging portion 105*b* in the rectangular parallelopipedic portion 102*b* positioned in the downstream side of the changing portion 105*a*.

Figure 10:
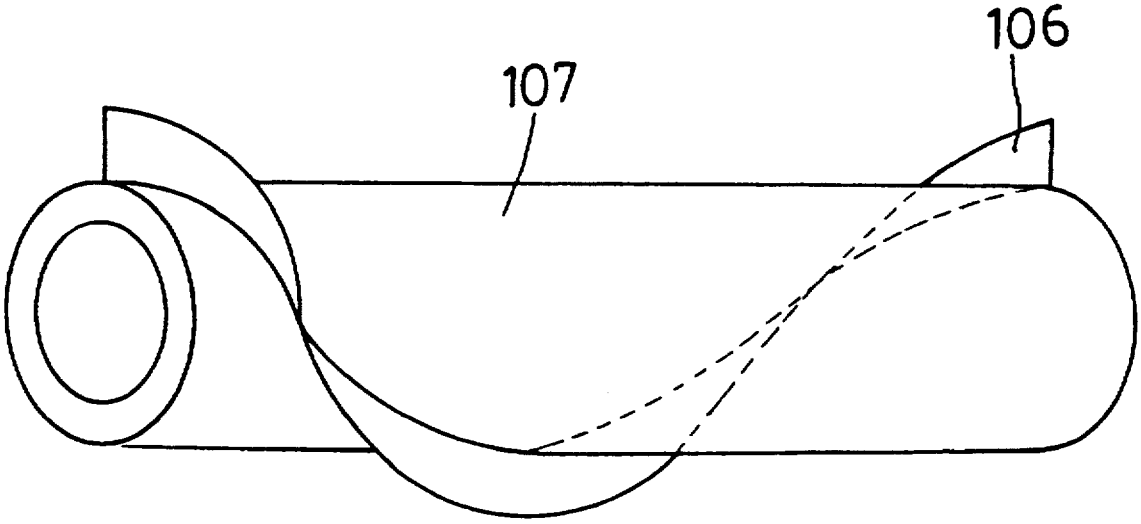
FIG. 10 is an oblique view of the blade of the third embodiment of the present invention.

The changing portion 105*a* is provided with a blade 106 illustrated in FIG. 10. The blade 106 is formed on an outer circumference of a cylindrical blade retention element 107. As illustrated in FIG. 9, the blade retention element 107 is supported by the body 102 via a support ring 113 in the changing portion 105*a* so as to be rotatable. The rotation axis of the blade retention element 107 is arranged along the transporting direction before the change, i.e., the axial direction of the cylindrical portion 102*a*. By this arrangement, the blade 106 is arranged along a spiral around the transporting direction before the change. As indicated by a two-dot chain line in FIG. 9, the paint inlet 103*a* and auxiliary air inlet 103*b* are arranged so that the powder paint and pressurized air introduced in the body 102 are guided to the blade 106. By this arrangement, the blade 106 is rotated by the pressure of the air for transporting the powder paint.

By the blade 106, the transporting direction of the powder paint introduced in the body 102 is changed from the axial direction to the radial direction of the cylindrical portion 102*a*. By this change of the transporting direction, the powder paint reaches the charging portion 105*b*. Also, by rotation of the blade 106, the powder paint is uniformly dispersed in the transportation path 105.

Plate-like elements 117 are bonded to the upper and lower portions of the inside face of the rectangular parallelopipedic portion 102*b*. A plurality of linear elements 111 are cantilevered by the two plate-like elements 117 so that the elements 111 are flexible. These linear elements 111 extend toward the charging portion 105*b* in the transportation path 105 like a brush. By this arrangement, each linear element 111 arranged in the transportation path 105 is capable of coming in contact with the powder paint on transportation. The direction of extension of each linear element 111 is vertical. The length of each linear element 111 is slightly shorter than the vertical dimension of the charging portion 105*b*.

The material of each of the linear elements 111 is electroconductive substance, such as an organic high molecular compound or a metal, which enables the powder paint to be charged by static electricity generated by friction between the powder paint and the elements 111. The radius and number of the linear elements 111 are set so as to ensure a sufficient powder paint blowing capacity.

Fourth embodiment

A fourth embodiment of the present invention is hereinafter described with reference to FIGS. 11 through 13.

Figure 11:
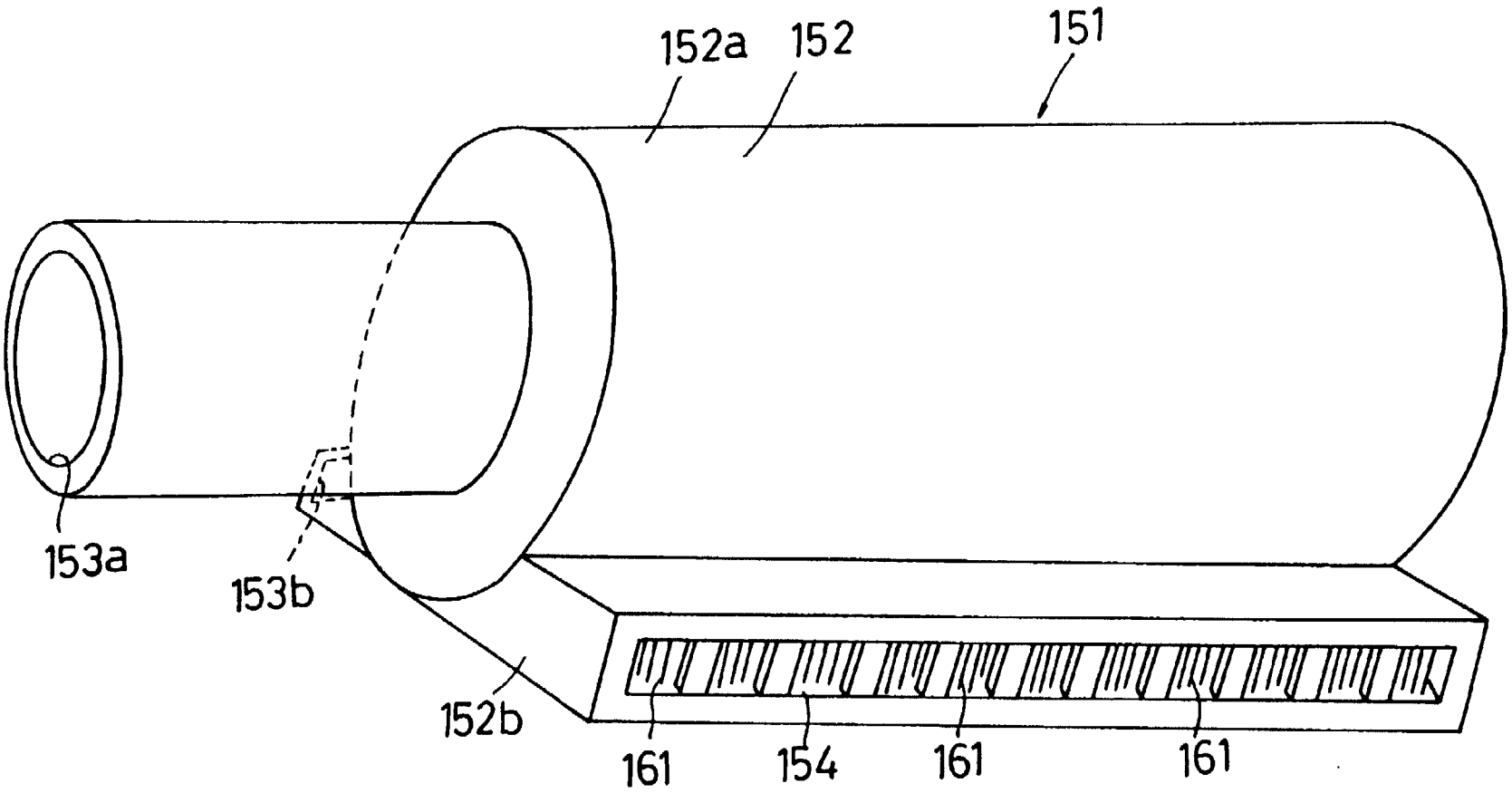
FIG. 11 is an oblique view of the electrostatic powder coating gun of the fourth embodiment of the present invention.

The body 152 of the electrostatic powder coating gun 151 illustrated in FIG. 11 has a cylindrical portion 152*a* and a rectangular parallelopipedic portion 152*b* extending from the outer circumference of the cylindrical portion 152*a*. The cylindrical portion 152*a* has a paint inlet 153*a* on one end face and an auxiliary air inlet 153*b* on the outer circumference. A paint outlet 154 is formed on the rectangular parallelopipedic portion 152*b*. Powder paint transported by pressurized air is introduced from the paint inlet 153*a* into the body 152. Pressurized air is introduced from the auxiliary air inlet 153*b* into the body 152. The powder paint charged in the body 152 is blown out together with the pressurized air from the outlet 154. The powder paint is blown to the subject of coating to form a coating film. The body 152 is preferably formed from an insulating material or coated with an insulating material such as rubber.

Figure 12:
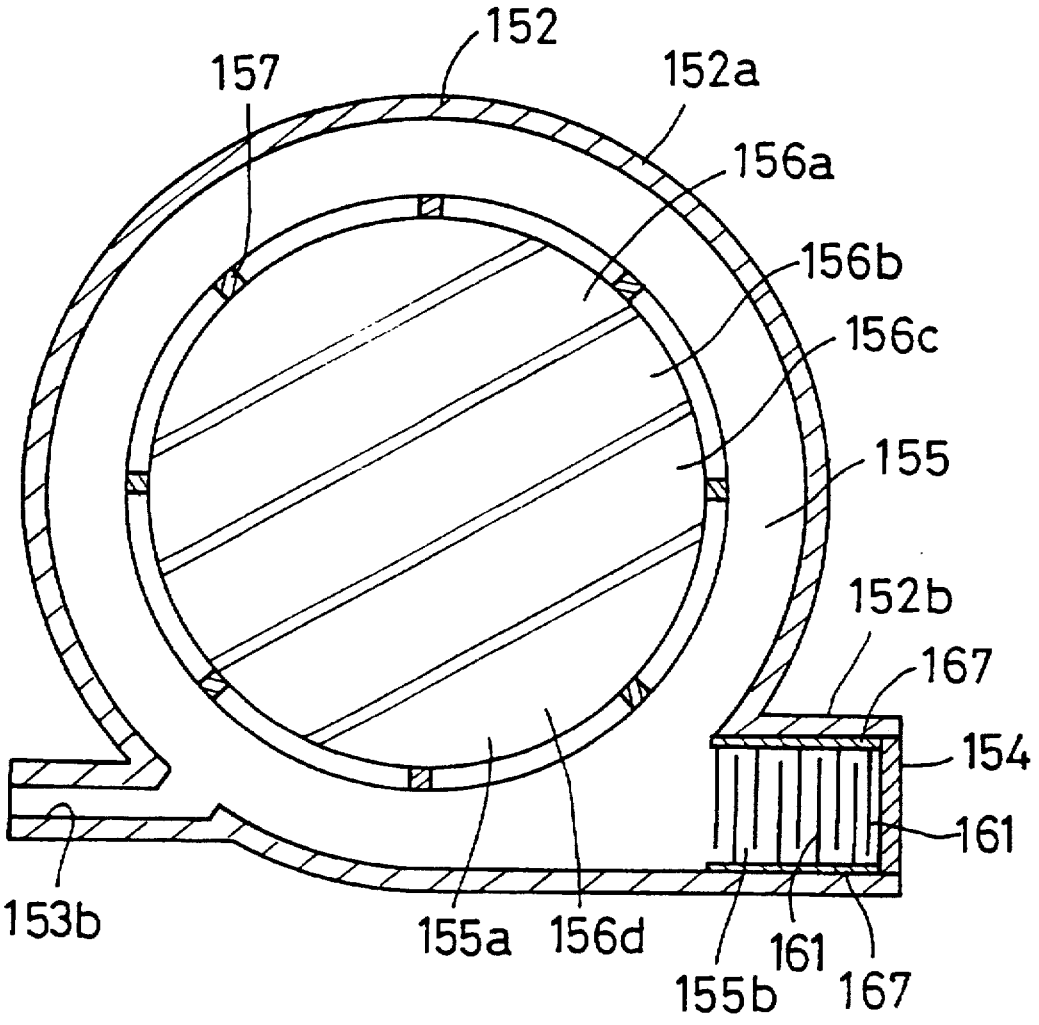
FIG. 12 is a transverse cross-sectional view of the electrostatic powder coating gun of the fourth embodiment of the present invention.

As illustrated in FIG. 12, the inside of the body 152 constitutes a transportation path 155 for the powder paint. The transportation path 155 has a transporting direction changing portion 155*a* within the cylindrical portion 152*a* and a charging portion 155*b* within the rectangular parallelopipedic portion 152*b* positioned in the downstream side of the changing portion 155*a*.

Figure 13:
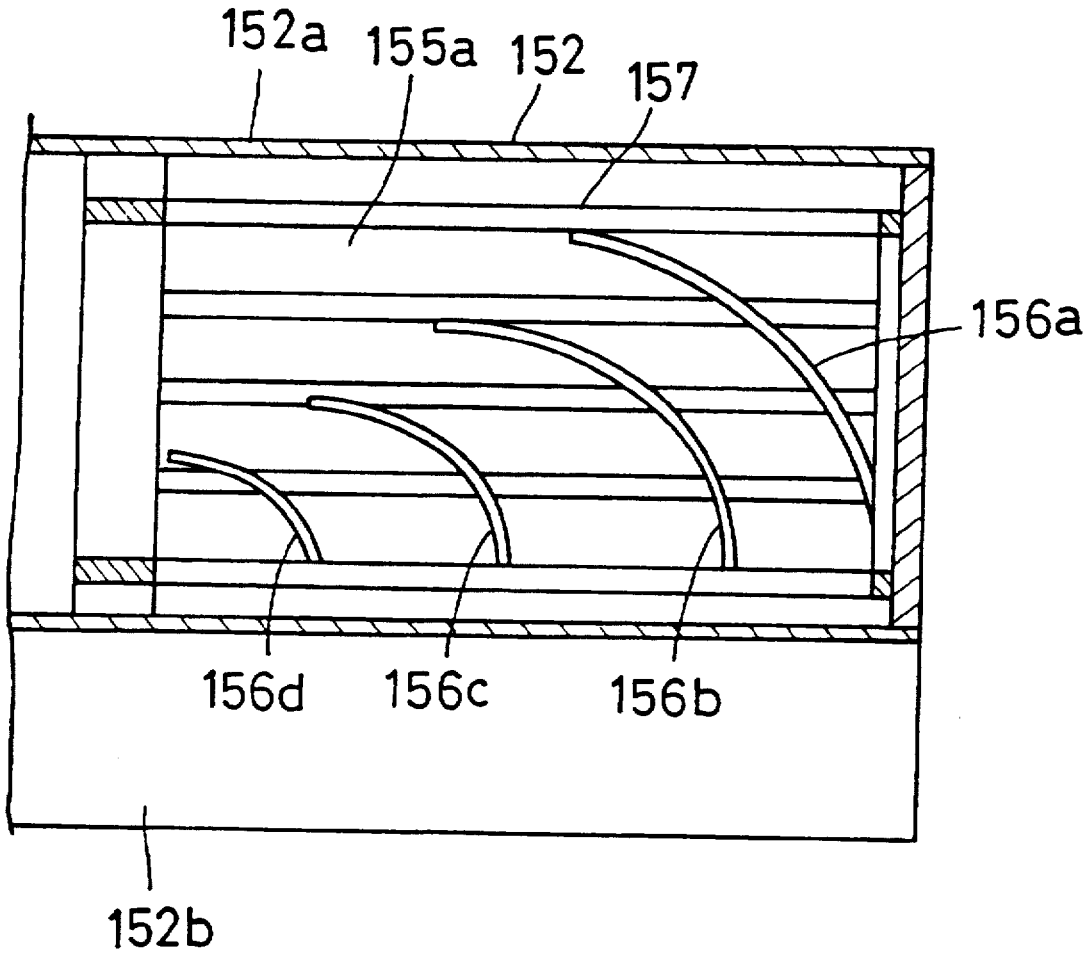
FIG. 13 is a longitudinal cross-sectional view of the electrostatic powder coating gun of the fourth embodiment of the present invention.

The changing portion 155*a* is provided with a plurality of blades 156*a*, 156*b*, 156*c* and 156*d* as illustrated in FIG. 13. In the changing portion 155*a*, each of the blades 156*a*, 156*b*, 156*c* and 156*d* is fixed to the inner circumference of a frame-like blade retention element 157, which is fixed to one inner end face of the cylindrical portion 152*a*. The blades 156*a*, 156*b*, 156*c* and 156*d* are arranged along the transporting direction before the change, i.e., the axial direction of the cylindrical portion 152*a*. The blades 156*a*, 156*b*, 156*c* and 156*d* are arranged so that the surface area of the blade positioned in the downstream side is greater than that positioned in the upstream side.

The transporting direction of the powder paint introduced from the paint inlet 153*a* into the changing portion 155*a* is changed from the axial direction of the cylindrical portion 152*a* to the direction toward the charging portion 155*b*, by the blades 156*a*, 156*b*, 156*c* and 156*d*. The air introduced from the auxiliary air inlet 153*b* into the body 152 promotes the introduction of the powder paint into the charging portion 155*b*. Because the surface area of the blade positioned in the downstream side is greater than that positioned in the upstream side, the powder paint is uniformly dispersed in the transportation path 155.

Plate-like elements 167 are bonded to the upper and lower portions of the inside face of the rectangular parallelopipedic portion 152*b* of the body 152. A plurality of linear elements 161 are cantilevered by the two plate-like elements 167 so that the elements 167 are flexible. These linear elements 161 extend toward the charging portion 155*b* in the transportation path 155 like a brush. By this arrangement, each linear element 161 arranged in the transportation path 155 is capable of coming in contact with the powder paint on transportation. The direction of extension of each linear element 161 is vertical. The length of each linear element 161 is slightly shorter than the vertical dimension of the charging portion 155*b*.

The material of each of the linear elements 161 is electroconductive substance, such as a metal or an organic high molecular compound containing electroconductive particles, which enables the powder paint to be charged by static electricity generated by friction between the powder paint and the elements 161. The radius and number of the linear elements 161 are set so as to ensure a sufficient powder paint blowing capacity.

Fifth embodiment

A fifth embodiment of the present invention is hereinafter described with reference to FIG. 14.

Figure 14:
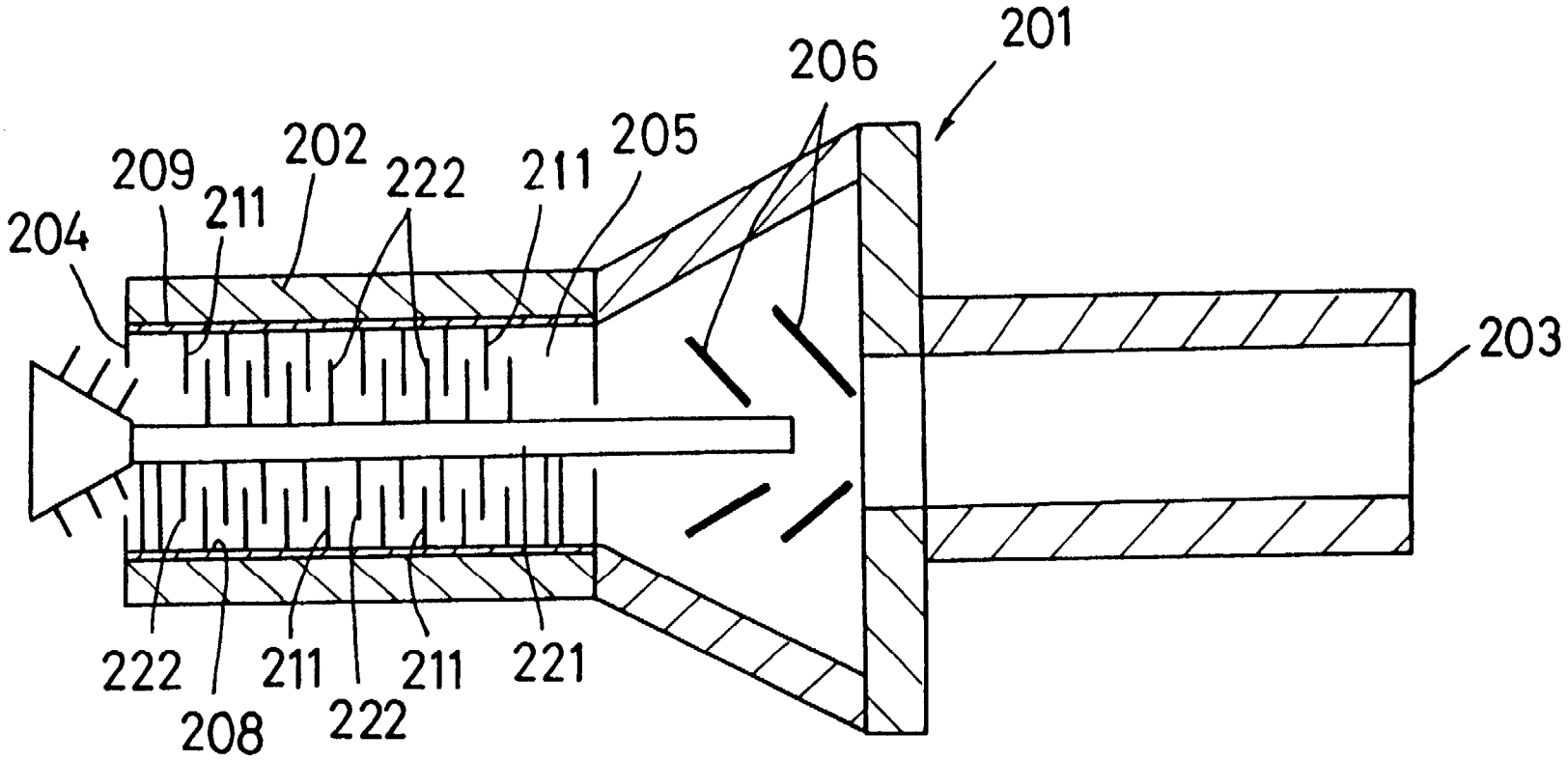
FIG. 14 is a longitudinal cross-sectional view of the electrostatic powder coating gun of the fifth embodiment of the present invention.

The electrostatic powder coating gun 201 illustrated in FIG. 14 has a cylindrical body 202. Powder paint transported by pressurized air is introduced from an inlet 203 into the body 202. After being charged in the body 202, the powder paint is blown out from an outlet 204 together with the pressurized air. The powder paint is blown to the subject of coating to form a coating film. The body 202 is preferably formed from an insulating material or coated with an insulating material such as rubber.

The inside of the body 202 constitutes a transportation path 205 of the powder paint. Dispersion blades 206 for dispersing the powder paint is attached to the inner face of the inlet side of the transportation path 205. The outlet side of the transportation path 205 is surrounded by a cylindrical face 208. The cylindrical face 208 is configured with the inner circumference of a cylindrical element 209 bonded to the inner circumference of the body 202.

By the cylindrical face 208, a plurality of first linear elements 211 are cantilevered so that the elements 211 are flexible. The first linear elements 211 extend toward the transportation path 205 like a brush. By this arrangement, each first linear element 211 arranged in the transportation path 205 is capable of coming in contact with the powder paint on transportation. The direction of extension of the first linear elements 211 is the radial direction of the cylindrical face 208. The cylindrical element 209 is made of a flexible square plate-like material such as rubber, which is cylindrically curved. Each first linear element 211 is attached to the cylindrical element 209 before curving the plate-like material. In the present embodiment, the length of each first linear element 211 is shorter than the radius of the transportation path 205 surrounded by the cylindrical face 208 because second linear elements 222 described below are provided.

A support element 221 passing the central axis of the cylindrical face 208 in the transportation path 205 is attached to the body 202. By the support element 221, a plurality of second linear elements 222 are cantilevered so that the elements 222 are flexible. These second linear elements 222 extend toward the transportation path 205, whereby each second linear element 222 arranged in the transportation path 205 is capable of coming in contact with the powder paint on transportation. Each second linear element 222 extends along the radial direction of the cylindrical face 208. The second linear elements 222 and the first linear elements 211 are arranged so that they do not interfere with each other. The length of each second linear element 222 is shorter than the radius of the cylindrical face 208. The length of each first linear element 211 is longer than the distance between each tip of the second linear element 222 and the cylindrical face 208. By this arrangement, the powder paint passing between the second linear elements 222 and the cylindrical face 208 is capable of coming in contact with the first linear elements 211. In place of this arrangement, the tip of each first linear element 211 can be brought into contact with the support element 221 and the tip of each second linear element 222 can be brought into contact with the cylindrical face 208. A diffusion element 226 for the powder paint is attached to the tip of the support element 221. The second linear elements 222 are also attached to the diffusion element 226.

The material of each of the linear elements 211 and 222 is an electroconductive substance, such as an organic high molecular compound or a metal, which enables the powder paint to be charged by static electricity generated by friction between the powder paint and the elements 211, 212. The radius and number of the linear elements 211 and 222 are set so as to ensure a sufficient powder paint blowing capacity.

Sixth embodiment

A sixth embodiment of the present invention is hereinafter described with reference to FIGS. 15 through 18.

Figure 15:
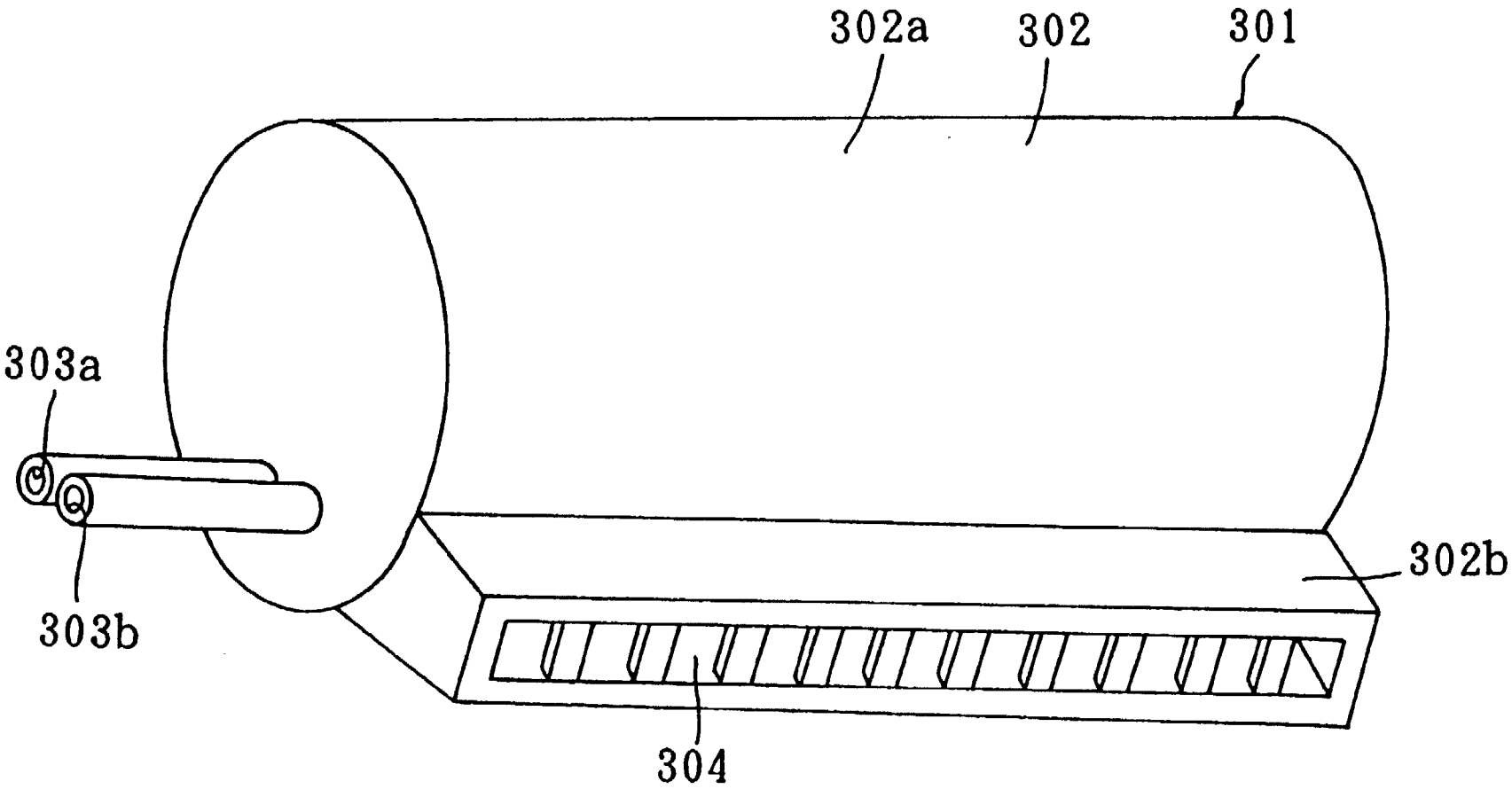
FIG. 15 is an oblique view of the electrostatic powder coating gun of the sixth embodiment of the present invention.

The body 302 of the electrostatic powder coating gun 301 illustrated in FIG. 15 has a cylindrical portion 302*a* and a prismatic portion 302*b* extending from the outer circumference of the cylindrical portion 302*a*. A paint inlet 303*a* and an auxiliary air inlet 303*b* are formed on one end face of the cylindrical portion 302*a*. A paint outlet 304 is formed on the prismatic portion 302*b*. Powder paint transported by pressurized air is introduced from the paint inlet 303*a* into the body 302. Pressurized air is introduced from the auxiliary air inlet 303*b* into the body 302. The powder paint charged in the body 302 is blown out together with the pressurized air from the outlet 304. The powder paint is blown to the subject of coating to form a coating film. The body 302 is preferably formed from an insulating material or coated with an insulating material such as rubber.

Figure 16:
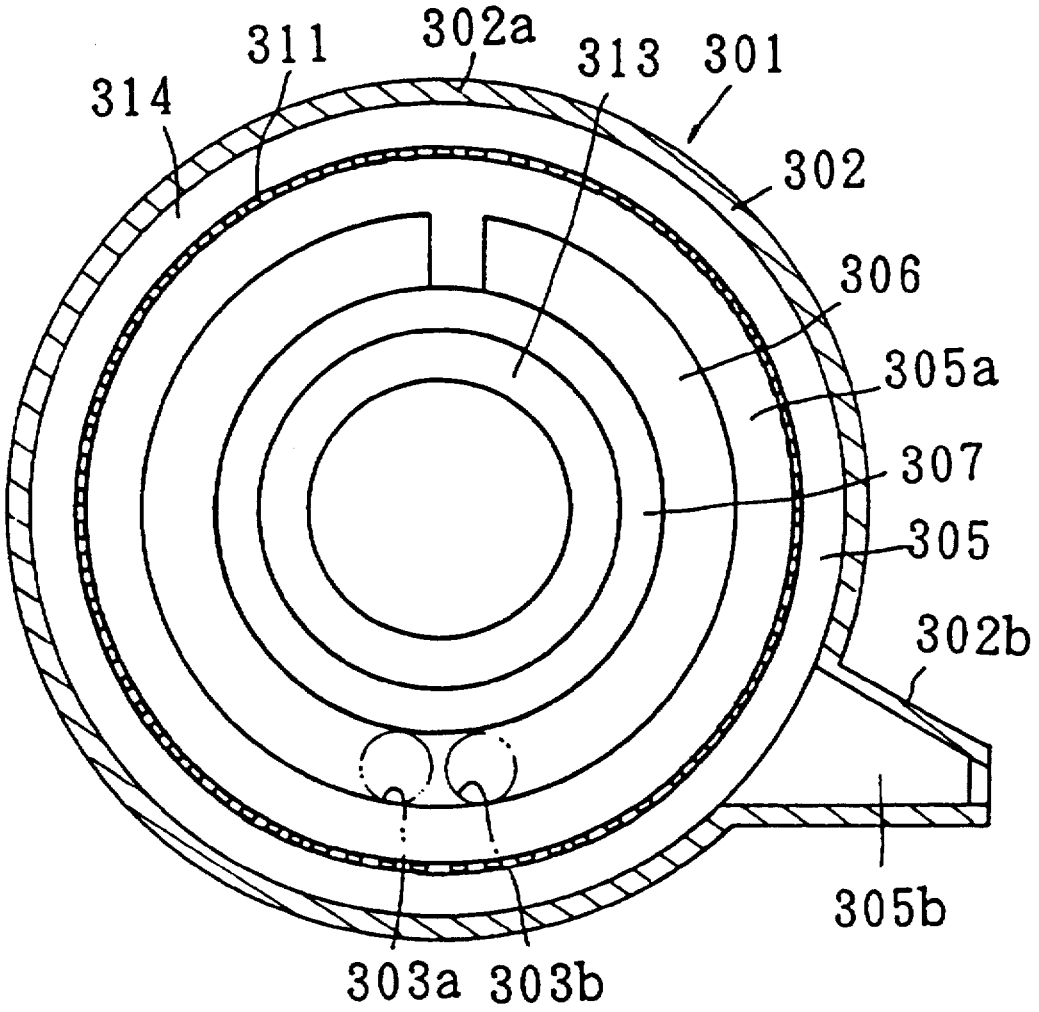
FIG. 16 is a transverse cross-sectional view of the electrostatic powder coating gun of the sixth embodiment of the present invention.

As also illustrated in FIG. 16, the inside of the body 302 constitutes a powder paint transportation path 305. The transportation path 305 has a transporting direction changing portion 305*a* within the cylindrical portion 302*a* and an exit portion 305*b* within the prismatic portion 302*b* positioned in the downstream side of the changing portion 305*a*.

Figure 17:
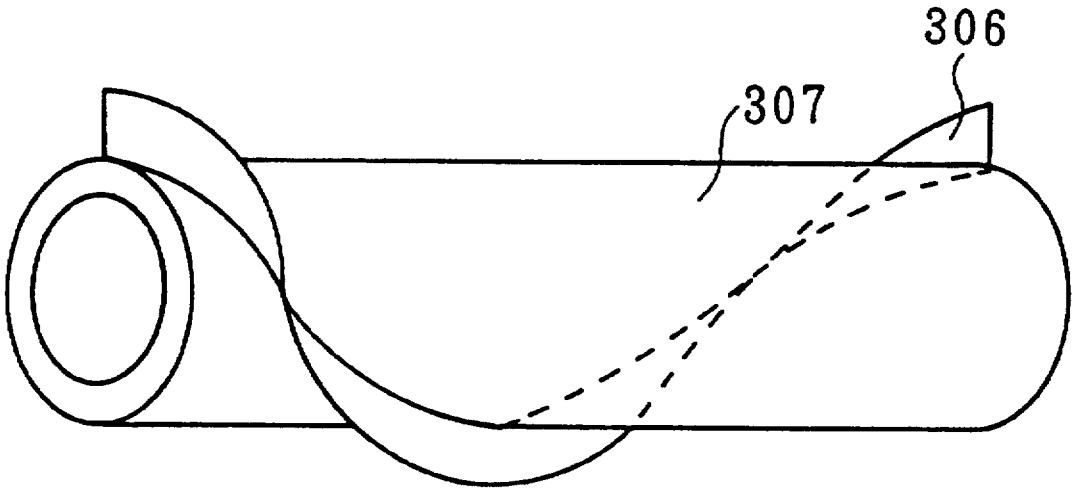
FIG. 17 is an oblique view of the blade of the sixth embodiment of the present invention.

The changing portion 305*a* is provided with a blade 306. As illustrated in FIG. 17, the blade 306 is arranged along a spiral on the outer circumference of a cylindrical blade retention element 307. As illustrated in FIG. 16, the blade retention element 307 is supported by the body 302 via a support ring 313 in the changing portion 305*a* so as to be rotatable. The rotation axis of the blade retention element 307 is arranged along the transporting direction before the change, i.e., the axial direction of the cylindrical portion 302*a*. By this arrangement, the blade 306 is arranged along a spiral around the transporting direction before the change. As indicated by a two-dot chain line in FIG. 16, the paint inlet 303*a* and auxiliary air inlet 303*b* are arranged so that the powder paint and pressurized air introduced in the body 302 reach the blade 306. By this arrangement, the blade 306 is rotated by the pressure of the air for transporting the powder paint.

By the blade 306, the transporting direction of the powder paint introduced in the body 302 is changed from the axial direction to the radial direction of the cylindrical portion 302*a*. By this change of the transporting direction, the powder paint reaches the exit portion 305*b*. By rotating the blade 306, the powder paint is uniformly dispersed in the transportation path 305.

Figure 18:
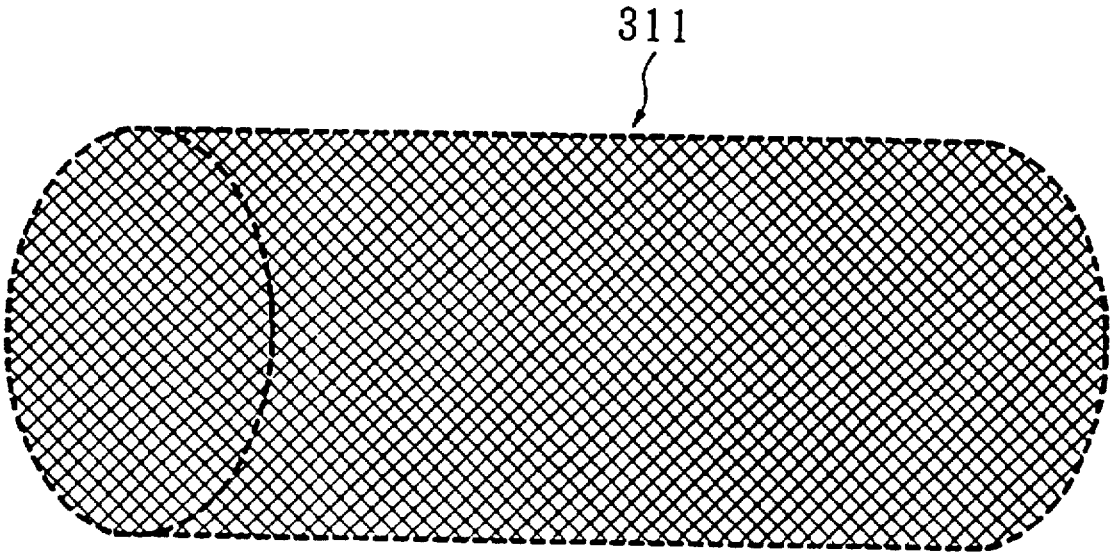
FIG. 18 is an oblique view of the meshed element of the sixth embodiment of the present invention.

The transportation path 305 is provided with a cylindrical meshed element 311 as illustrated in FIG. 18. The meshed element 311 is arranged along a cylindrical face surrounding the blade 306. The mesh size of the meshed element 311 is greater than the size of the particles constituting the powder paint. By this arrangement, the meshed element 311 is capable of coming in contact with the powder paint on transportation, after the change of the transporting direction of the powder paint. The meshed element 311 is supported by the body 302 via a support ring 314 in the changing portion 305*a* so as to be rotatable. The rotation axis of the meshed element 311 is arranged along the transporting direction before the change, i.e., the axial direction of the cylindrical portion 302*a* . By this arrangement, the meshed element 311 is rotated by the pressure of the air for transporting the powder paint.

The material of the meshed element 311 is an electroconductive substance, such as an organic high molecular compound or a metal, which enables the powder paint to be charged by static electricity generated by friction between the powder paint and the element 311. By this arrangement, the charged powder paint is blown out from the outlet 304 via the exit portion 305*b*. The dimensions of the meshed element 311 are set so as to ensure a sufficient powder paint blowing capacity.

Seventh embodiment

A seventh embodiment of the present invention is hereinafter described with reference to FIGS. 19 through 21.

Figure 19:
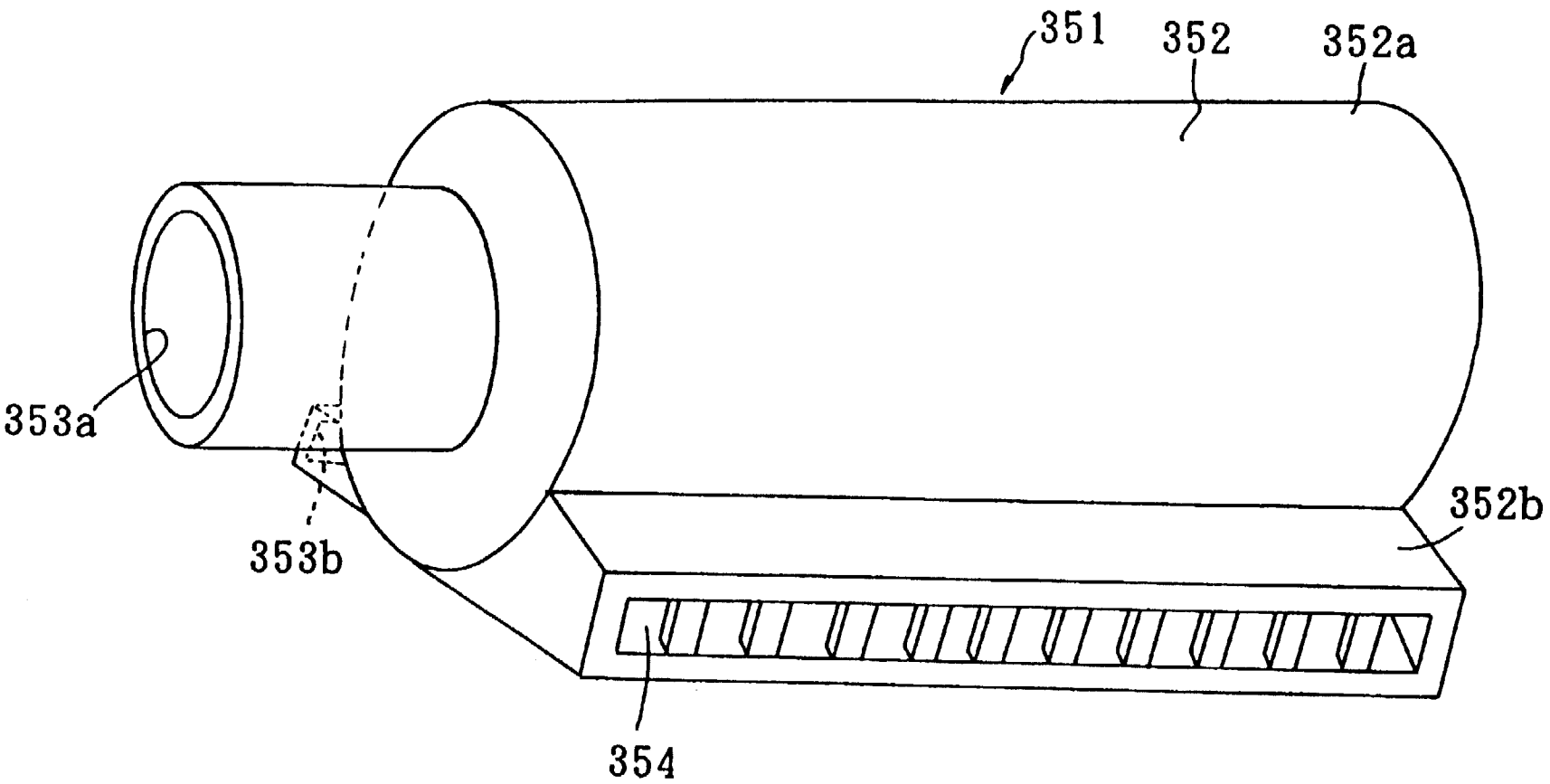
FIG. 19 is an oblique view of the electrostatic powder coating gun of the seventh embodiment of the present invention.

The body 352 of the electrostatic powder coating gun 351 as illustrated in FIG. 19 has a cylindrical portion 352*a* and a prismatic portion 352*b* extending from the outer circumference of the cylindrical portion 352*a*. The cylindrical portion 352*a* has a paint inlet 353*a* on one end face and an auxiliary air inlet 353*b* in the outer circumference. A paint outlet 354 is formed on the prismatic portion 352*b*. Powder paint transported by pressurized air is introduced from the paint inlet 353*a* into the body 352. Pressurized air is introduced from the auxiliary air inlet 353*b* into the body 352. The powder paint charged in the body 352 is blown out together with the pressurized air from the outlet 354. The powder paint is blown to the subject of coating to form a coating film. The body 352 is preferably formed from an insulating material or coated with an insulating material such as rubber.

Figure 20:
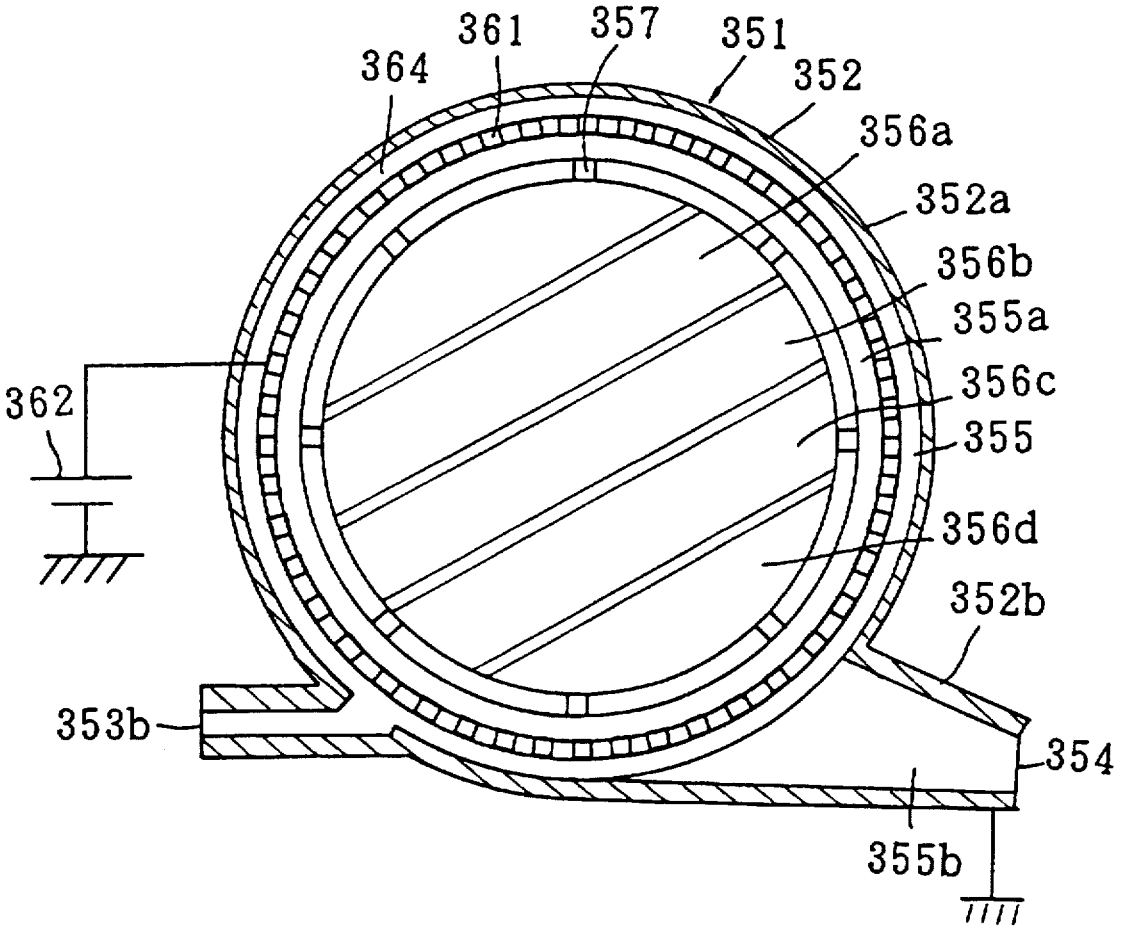
FIG. 20 is a transverse cross-sectional view of the electrostatic powder coating gun of the seventh embodiment of the present invention.
Figure 21:
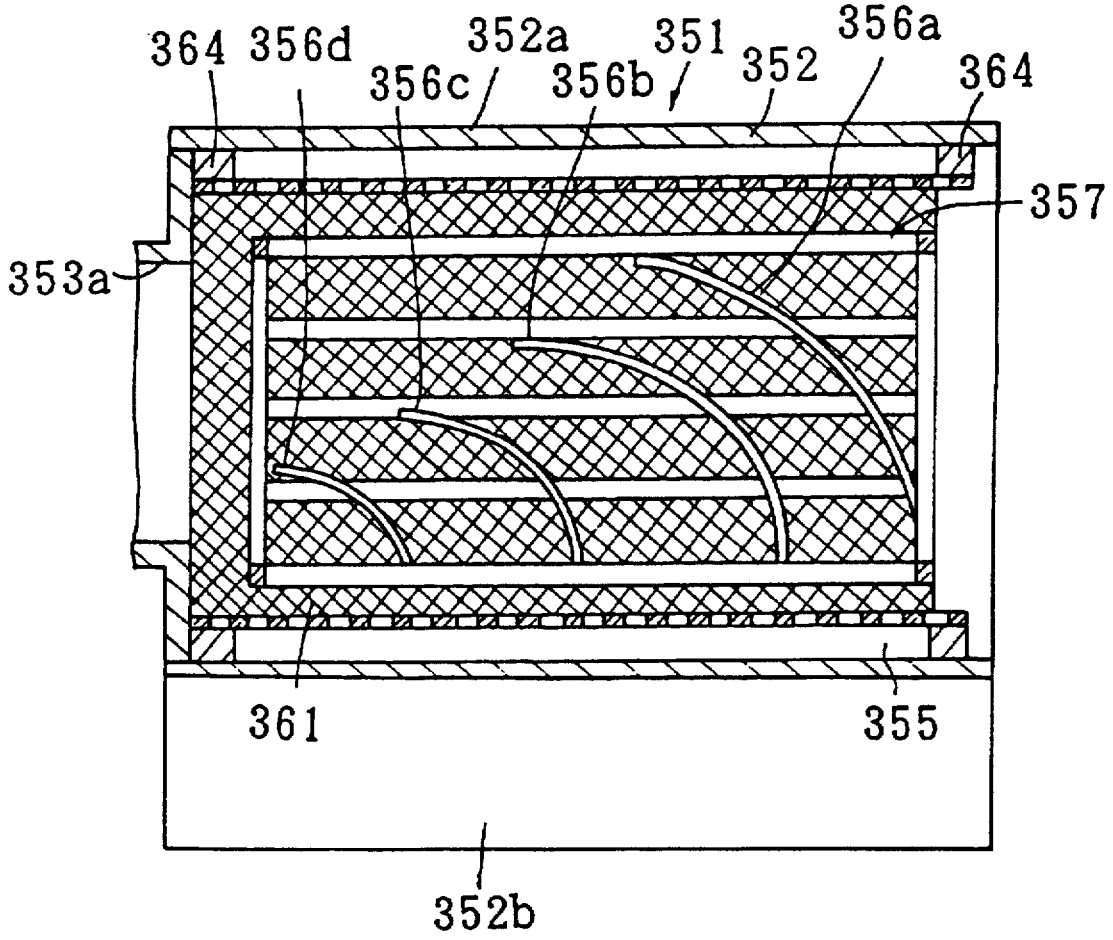
FIG. 21 is a longitudinal cross-sectional view of the electrostatic powder coating gun of the seventh embodiment of the present invention.

As illustrated in FIGS. 20 and 21, the inside of the body 352 constitutes a powder paint transportation path 355. This transportation path 355 has a transporting direction changing portion 355*a* within the cylindrical portion 352*a* and an exit portion 355*b* within the prismatic portion 352*b* positioned in the downstream side of the changing portion 355*a*.

The changing portion 355*a* is provided with a plurality of blades 356*a*, 356*b*, 356*c* and 356*d*. In the changing portion 355*a*, each of the blades 356*a*, 356*b*, 356*c* and 356*d*. is fixed to the inner circumference of a frame-like blade retention element 357, which is fixed to the inner end surface of the cylindrical portion 352*a*. The blades 356*a*, 356*b*, 356*c* and 356*d* are arranged along the transporting direction before the change, i.e., the axial direction of the cylindrical portion 352*a*. The surface area of the blade positioned in the downstream side is greater than that positioned in the upstream side.

The transporting direction of the powder paint introduced from the paint inlet 353*a* into the changing portion 355*a* is changed from the axial direction of the cylindrical portion 352*a* to the direction toward the exit portion 355*b* by the blades 356*a*, 356*b*, 356*c* and 356*d* . The air introduced from the auxiliary air inlet 353*b* into the body 352 promotes the introduction of the powder paint into the exit portion 355*b*. Because the surface area of the blade positioned in the downstream side is greater than that positioned in the upstream side, the powder paint is uniformly dispersed in the transportation path 355.

The transportation path 355 is provided with a cylindrical meshed element 361 arranged along a cylindrical face surrounding the blades 356*a*, 356*b*, 356*c* and 356*d*. The mesh size of the meshed element 361 is greater than the size of the particles constituting the powder paint. By this arrangement, the meshed element 361 is capable of coming in contact with the powder paint on transportation, after the change of the transporting direction. The meshed element 361 is supported concentrically with the center of the transporting direction before the change, i.e., the axial direction of the cylindrical portion 352*a*, by the body 352 via a support ring 364 in the changing portion 355*a*.

A power source 362 for charging the meshed element 361 is provided. The power source 362 is connected to the meshed element 361 at one electrode and earthed at the other electrode. The material of the meshed element 361 is electroconductive substance. By this arrangement, frictional charging of the powder paint as described below is promoted by the charge applied to the meshed element 361. The insulating portion of the body 352 is preferably earthed.

The material of the meshed element 361 is electroconductive substance, such as a metal or an organic high molecular compound containing electroconductive particles, which enables the powder paint to be charged by static electricity generated by friction between the powder paint and the element 361. By this arrangement, the charged powder paint is blown out from the outlet 354 via the exit portion 355*b*. The dimensions of the meshed element 361 are set so as to ensure a sufficient powder paint blowing capacity.

Eighth embodiment

An eighth embodiment of the present invention is hereinafter described with reference to FIG. 22.

Figure 22:
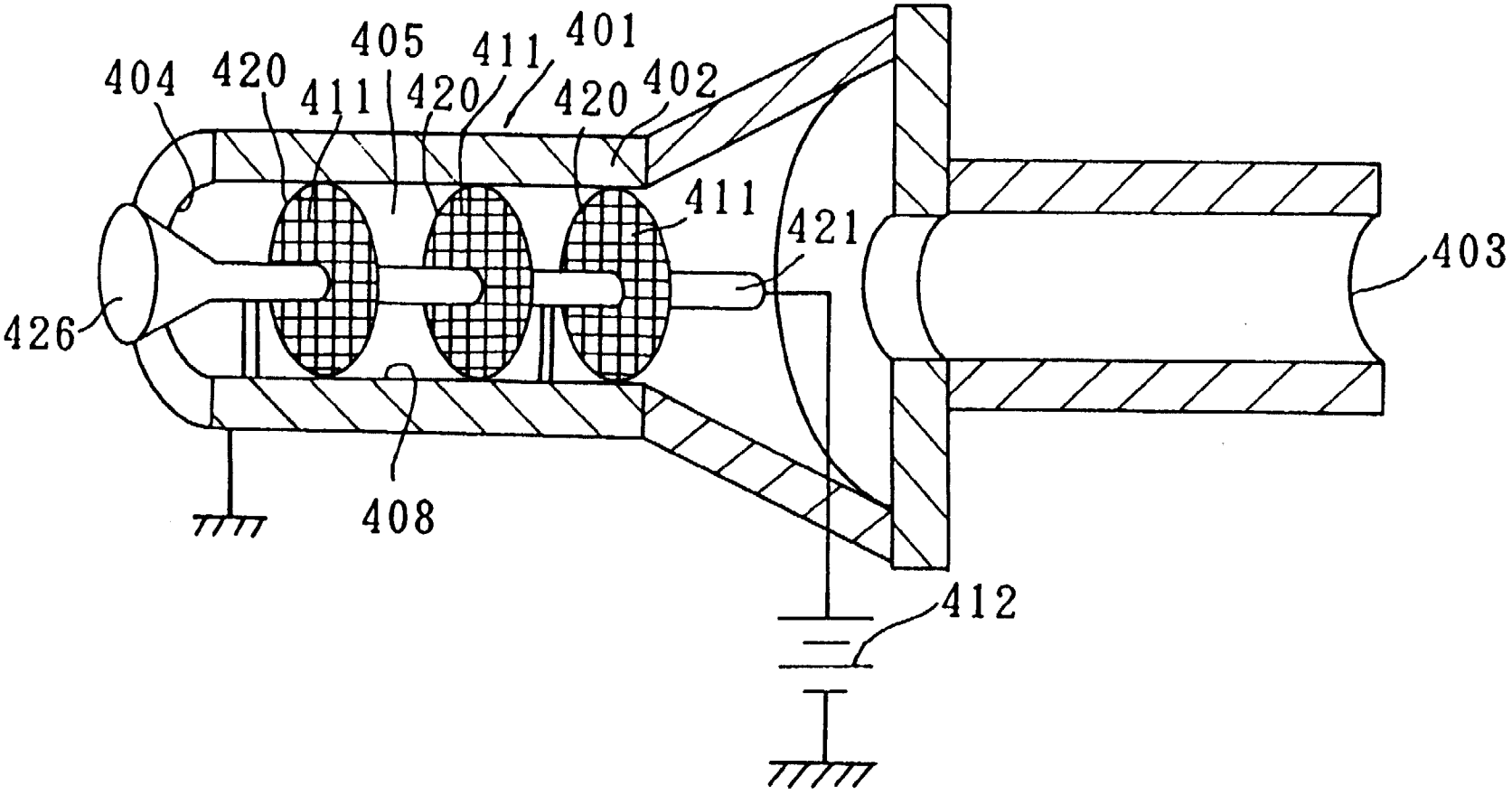
FIG. 22 is a longitudinal cross-sectional view of the electrostatic powder coating gun of the eighth embodiment of the present invention.

The electrostatic powder coating gun 401 illustrated in FIG. 22 has a cylindrical body 402. Powder paint transported by pressurized air is introduced from an inlet 403 into the body 402. After being charged in the body 402, the powder paint is blown out from an outlet 404 together with the pressurized air. The powder paint is blown to the subject of coating to form a coating film. The body 402 is preferably formed from an insulating material or coated with an insulating material such as rubber.

The inside of the body 402 constitutes a powder paint transportation path 405. The inlet side of the transportation path 405 is surrounded by a conical face that tapers toward the outlet side. The outlet side of the transportation path 405 is surrounded by a cylindrical face 408.

By the cylindrical face 408 on the inner circumference of the transportation path 405, a plurality of ring-shaped support elements 420 are supported in an array along the direction of the powder paint transporting direction. By the inner circumference of each support element 420, a meshed element 411 is retained. The mesh size of the meshed element 411 is greater than the size of the particles constituting the powder paint. By this arrangement, each meshed element 411 arranged in the transportation path 405 is capable of coming in contact with the powder paint on transportation.

A shaft 421 penetrating each meshed element 411 is attached to the body 402. A powder paint diffusion element 426 is attached to the tip of the shaft 421.

A power source 412 for charging the meshed element 411 is provided. The power source 412 is connected to one end of the shaft 421 at one electrode and earthed at the other electrode. The material of the meshed element 411, the shaft 421 and the support element 420 is electroconductive substance. By this arrangement, frictional charging of the powder paint as described below is promoted by the charge applied to each meshed element 411. The insulating portion of the body 402 is preferably earthed.

The material of each of the meshed element 411 is electroconductive substance, such as a metal or an organic high molecular compound containing electroconductive particles, which enables the powder paint to be charged by static electricity generated by friction between the powder paint and the element 411. By this arrangement, the charged powder paint is blown out from the outlet 404. The dimensions and number of the meshed elements 411 are set so as to ensure a sufficient powder paint blowing capacity.

Ninth embodiment

Figure 23:
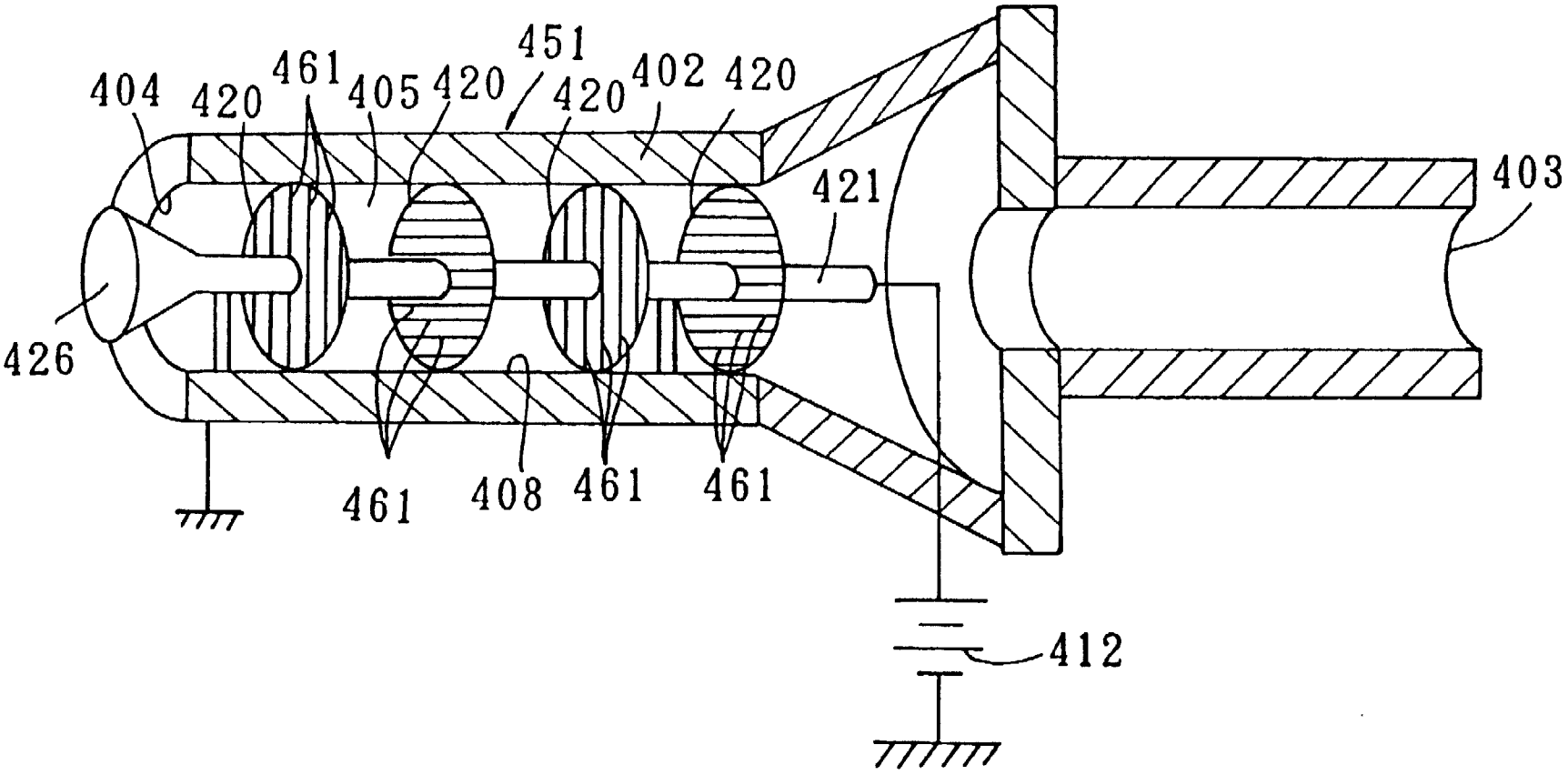
FIG. 23 is a longitudinal cross-sectional view of the electrostatic powder coating gun of the ninth embodiment of the present invention.

The electrostatic powder coating gun 451 of a ninth embodiment of the present invention is hereinafter described with reference to FIG. 23. Differences from the eighth embodiment are described, and common portions to this embodiment and the eighth embodiment are indicated by the same symbols.

The difference from the eighth embodiment is that a plurality of linear elements 461 are supported at both ends by the inner circumference of each support element 420. The longitudinal direction of each linear element 461 is parallel to the radial direction of the cylindrical face 408. The longitudinal directions of the plurality of linear elements 461 supported by the same support element 420 are parallel to each other. The longitudinal directions of the linear elements 461 supported by each support element 420 are not parallel to the longitudinal directions of the linear elements 461 supported by the adjoining support element 420. The interval of the plurality of linear elements 461 in each support element 420 is greater than the size of the particles constituting the powder paint. By this arrangement, each linear element 461 arranged in the transportation path 405 is capable of coming in contact with the powder paint on transportation.

A power source 412 for charging each linear element 461 is provided. The power source 412 is connected to one end of the shaft 421 at one electrode and earthed at the other electrode. The material of the linear element 461, the support element 420 and the shaft 421 is electroconductive substance. By this arrangement, frictional charging of the powder paint as described below is promoted by the charge applied to each linear element 461. The insulating portion of the body 402 is preferably earthed.

The material of each of the linear element 461 is electroconductive substance, such as a metal or an organic high molecular compound containing electroconductive particles, which enables the powder paint to be charged by static electricity generated by friction between the powder paint and the element 461. By this arrangement, the charged powder paint is blown out from the outlet 404. The radius and number of the linear elements 461 are set so as to ensure a sufficient powder paint blowing capacity. The other aspects are the same as those in the eighth embodiment.

Because the electrostatic powder coating guns 1, 51, 101, 151, 201, 301, 351, 401 and 451 of the above-described embodiments charge powder paint by static electricity generated by friction, ozone odor is not generated, the entry of powder paint into the hollows of the subject of coating is good, and craters and pinholes are unlikely to occur in the coating film. This facilitates the obtainment of a smooth uniform coating film with minimum dust adhesion. The static electricity can be generated by contacting the linear elements 11, 22, 61, 111, 161, 211 and 222 with the particles of the powder paint in the transportation paths 5, 55, 105, 155 and 205, by contacting the meshed elements 311, 361 and 411 with the particles of the powder paint in the transportation paths 305, 355 and 405, or by contacting the linear element 461 with the particles of the powder paint in the transportation path 405. The chance of contact between the linear elements 11, 22, 61, 111, 161, 211 and 222 and the particles increases in proportion to the number of linear elements 11, 22, 61, 111, 161, 211 and 222. The chance of contact between the meshed elements 311, 361 and 411 and the particles increases in proportion to the number of opens of the meshed elements 311, 361 and 411. The chance of contact between the linear element 461 and the particles increases in proportion to the number of the linear elements 461. By this arrangement, the charge efficiency of the particle can be improved significantly. By increasing the charge efficiency, the maximum blowing capacity and coating efficiency of the powder paint is increased, so that quick coating is possible even when the subject of coating has a wide surface area. Because the linear elements 11, 22, 61, 111, 161, 211 and 222 are flexible by contact with the powder paint, the wear due to the contact is mitigated, resulting in extended life. Because the flexibility of the linear elements 11, 22, 61, 111, 161, 211 and 222 prevents the powder paint from accumulating thereon, the powder paint can be stably charged. Also, because structural simplicity reduces cost and facilitates maintenance and cleaning, the use of powder paint of different colors is facilitated.

In the electrostatic powder coating guns 1 and 201 of the above-described first and fifth embodiments, each of the linear elements 11, 22, 211 and 222 extends from the cylindrical faces 8 and 208 and the support elements 21 and 221, which passes the central axes of the cylindrical faces 8 and 208, toward the transportation paths 5 and 205 surrounded by the cylindrical faces 8 and 208. Because the chance of contact between each of the linear elements 11, 22, 211 and 222 and the particles can be thus uniformized, the charge efficiency can be uniformly improved to obtain a uniform coating film.

In the electrostatic powder coating gun 1 of the above-described first embodiment, the linear elements 11 and 22 are arranged along a spiral around the transporting direction of the powder paint. The powder paint can be thus rotated, so that the chance of contact between the linear elements 11 and 22 and the powder paint is increased. By this arrangement, the charge efficiency for the powder paint can be further improved.

In the electrostatic powder coating gun 51 of the above-described second embodiment, the linear elements 61 extend from the cylindrical faces 58*a*, 58*b*, 58*c* and 58*d* to the transportation path portions 55*a*, 55*b*, 55*c* and 55*d* surrounded by a plurality of cylindrical faces 58*a*, 58*b*, 58*c* and 58*d*. By this arrangement, the chance of contact between the linear elements 61 and the powder paint can be increased to improve the charge efficiency. Also, the powder paint can be uniformly charged by uniformly dispersing it to obtain a uniform coating film. Furthermore, by applying a charge to each linear element 61, powder paint charge efficiency can be further improved.

In the electrostatic powder coating guns 101 and 151 of the above-described third and fourth embodiments, the chance of contact between the linear elements 111 and 161 and the powder paint can be increased to improve charge efficiency by dispersing the powder paint by the blades 106, 156*a*, 156*b*, 156*c* and 156*d*. Also, the powder paint can be uniformly charged by uniformly dispersing it when the transporting direction of the powder paint is changed by the blades 106, 156*a*, 156*b*, 156*c* and 156*d*.

In the electrostatic powder coating gun 201 of the above-described fifth embodiment, the powder paint can be uniformly charged, because it is dispersed by the dispersion blade 206 before being brought into contact with the linear elements 211 and 222.

According to the electrostatic powder coating guns 301 and 351 of the above-described sixth and seventh embodiments, the chance of contact between the meshed elements 311 and 361 and the powder paint can be increased to improve the charge efficiency by dispersing the powder paint by the blades 306, 356*a*, 356*b*, 356*c* and 356*d*. Also, the powder paint can be uniformly charged by uniformly dispersing it by the blades 306, 356*a*, 356*b*, 356*c* and 356*d* before being brought into contact with the meshed elements 311 and 361. Furthermore, because the meshed elements 311 and 361 are arranged along a cylindrical face surrounding the blades 306, 356*a*, 356*b*, 356*c* and 356*d*, the chance of contact with the powder paint is significantly increased to improve the charge efficiency.

According to the electrostatic powder coating gun 301 of the above-described sixth embodiment, the meshed element 311 can contact with the powder paint without localizing the contact point to prevent the meshed element 311 from clogging, because the meshed element 311 arranged along the cylindrical face rotates.

According to the electrostatic powder coating guns 351, 401 and 451 of the above-described seventh through ninth embodiments, the powder paint charge efficiency can be further improved by applying a charge to the meshed elements 361 and 411 or the linear element 461.

Because the above-described electrostatic powder coating guns 1, 51, 101, 151, 201, 301, 351, 401 and 451 are capable of uniformly improving the powder paint charge efficiency, they are suited for blowing powder paint of a single uniform hue, which is obtained by mixing different powder paints of two or more hues, for color coating.

In this case, for obtaining a uniform mixed powder paint, the loose apparent density difference between the powder paints to be mixed is preferably within 0.02 g/cc.

For uniformly coating the subject by the powder paint, the charge amount difference between the powder paints to be mixed is preferably within 5 μC/g, the dielectric constant difference is preferably within 0.2, and the resistance ratio is preferably between 1/10 and 10.

For uniformly setting the coated powder paint, it is preferable that the softening point difference between the powder paints to be mixed is within 5° C., that the melt viscosity difference at 120° C. is within 300 cp, more preferably within 100 cp, and that the setting time difference is within 2 minutes, more preferably within 1 minute.

Figure 24:
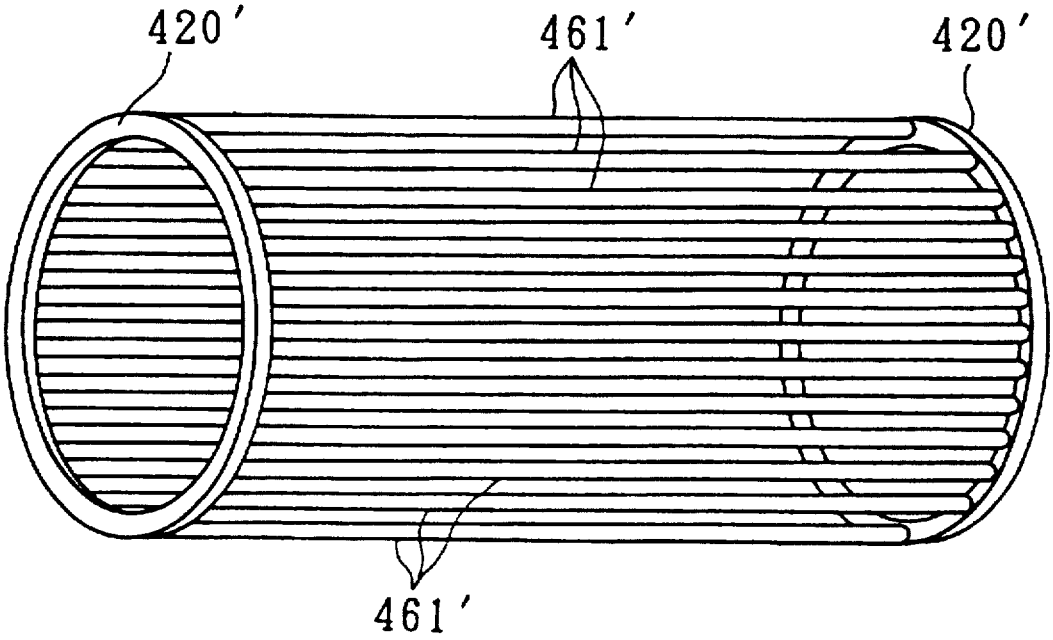
FIG. 24 is an oblique view of the linear elements of a modification of the present invention.

The present invention is not limited to the above-described embodiments. An electrostatic powder coating gun combining characteristics of the above-described embodiments can be constituted. Also, the setting and arrangement of the linear elements are not subject to limitation. Also, in the electrostatic powder coating guns 301 and 351 in the sixth and seventh embodiments, the cylindrical meshed elements 311 and 361 can be replaced with a plurality of mutually parallel linear elements 461' supported at both ends by a ring-shaped support element 420', as illustrated in FIG. 24. In this case, the interval of the linear elements 461' is greater than the size of powder particles. Also, the arrangement of the meshed elements is not subject to limitation; for example, the cylindrical meshed elements 311 and 361 in the sixth and seventh embodiments can be replaced with plate-like meshed elements arranged in the exit portions **305*b* and 355*b***. Also, the materials of the linear elements and meshed elements are not subject to limitation, as long as they are capable of charging the powder paint by static electricity generated by friction between the powder paint and the elements.

What is claimed is:

1. An electrostatic powder coating gun, comprising:

a transportation path for powder paint; and a plurality of linear elements arranged in the transportation path so that the linear elements can come in contact with the powder paint on transportation;

wherein the linear elements are cantilevered so as to form at least one flexible brush, and wherein the material of the linear elements is that which enables the powder paint to be charged by static electricity generated by friction between the powder paint and the linear elements.

2. The electrostatic powder coating gun according to claim 1, wherein:

the transportation path has a portion surrounded by a cylindrical face, and the linear elements cantilevered by the cylindrical face extend toward the transportation path.

3. The electrostatic powder coating gun according to claim 1 wherein:

the transportation path has a portion surrounded by a cylindrical face, a support element passing a central axis of the cylindrical face, and the linear elements cantilevered by the support element extend toward the transportation path.

4. The electrostatic powder coating gun according to claim 1, wherein:

the linear elements are arranged along a spiral around the transporting direction of the powder paint.

5. The electrostatic powder coating gun according to claim 1, wherein:

the transportation path comprises a plurality of portions surrounded by a plurality of mutually concentric cylindrical faces, and the linear elements cantilevered by each cylindrical face extend toward each portion of the transportation path.

6. The electrostatic powder coating gun according to claim 1, further comprising:

means for charging each linear element.

7. The electrostatic powder coating gun according to claim 1, wherein:

the transportation path has a transporting direction changing portion provided with a blade for changing the transporting direction of the powder paint, and the portion of the transportation path positioned in the downstream of the changing portion constitutes the charging portion where the linear elements are arranged.

8. The electrostatic powder coating gun according to claim 7, wherein:

the blade is arranged along a spiral around the powder paint transporting direction before the change, and is rotated by the pressure of gas for transporting the powder paint.

9. The electrostatic powder coating gun according to claim 7, wherein:

a plurality of blade are provided along the transporting direction before the change, and the surface area of the blade positioned in the downstream side is greater than that positioned in the upstream side.

10. The electrostatic powder coating gun according to claim 1, further comprising:

means for dispersing the powder paint introduced in the transportation path, before the powder is brought into contact with the linear elements.

11. A method of coating a surface of an object with powder paint, comprising blowing the powder paint through the electrostatic powder coating gun of claim 1 on the surface.

12. The electrostatic powder coating gun, comprising:

a transportation path for powder paint, wherein the transportation path has a transporting direction changing portion provided with a blade for changing the transporting direction of the powder paint, and a meshed element is arranged at a position where the powder paint passes after the change of the transporting direction; and a meshed element arranged in the transportation path so that the meshed element can come in contact with the powder paint on transportation, wherein the mesh size of the meshed element is greater than the size of the particles constituting the powder paint, and wherein the material of the meshed element is that which enables the powder paint to be charged by static electricity generated by friction between the powder paint and the meshed element.

13. The electrostatic powder coating gun according to claim 12, wherein:

the blade is arranged along a spiral around the powder paint transporting direction before the change, and is rotated by the pressure of gas for transporting the powder paint.

14. The electrostatic powder coating gun according to claim 12, wherein:

a plurality of blades are provided along the transporting direction before the change, and the surface area of the blade positioned in the downstream side is greater than that positioned in the upstream side.

15. The electrostatic powder coating gun according to claim 12, wherein:

the meshed element is formed along a cylindrical face surrounding the blade.

16. The electrostatic powder coating gun according to claim 15, wherein:

the meshed element is rotated by the pressure of the gas for transporting the powder paint.

* * * * *

UNITED STATES PATENT AND TRADEMARK OFFICE

CERTIFICATE OF CORRRECTION

PATENT NO. : 5,894,989
DATED : April 20, 1999
INVENTOR(S) : Shinichiro Yasuda, et al.

It is certified that error appears in the above-identified patent and that said Letters Patent is hereby corrected as shown below:

On the title page item [56], insert --

U. S. PATENT DOCUMENTS

| EXAMINER INITIAL | | PATENT NUMBER | | | | | | | ISSUE DATE | PATENTEE | CLASS | SUBCLASS | FILING DATE IF APPROPRIATE |
|---|---|---|---|---|---|---|---|---|---|---|---|---|---|
| | | 4 | 3 | 9 | 9 | 9 | 4 | 5 | 08/23/1983 | Ruud | | | |
| | | 4 | 5 | 9 | 7 | 5 | 3 | 4 | 07/01/1986 | Ruud | | | |

--.

Signed and Sealed this

Ninth Day of November, 1999

*Attest:*

Q. TODD DICKINSON

*Attesting Officer*

*Acting Commissioner of Patents and Trademarks*